US005451004A

United States Patent [19]

Altonji et al.

[11] Patent Number: 5,451,004

[45] Date of Patent: Sep. 19, 1995

[54] INTEGRATED WASTE PULPING AND LIQUID EXTRACTION SYSTEM

[75] Inventors: Robert W. Altonji, Coatesville; Robert J. Cohn, Dallas; Steven M. Eno, Strasburg; Albert Kolvites, Mountaintop, all of Pa.

[73] Assignee: Somat Corporation, Coatesville, Pa.

[21] Appl. No.: 118,433

[22] Filed: Sep. 8, 1993

[51] Int. Cl.[6] ..... B02C 23/10; B02C 23/26

[52] U.S. Cl. ..... 241/46.17; 209/234; 241/79

[58] Field of Search ..... 241/46.11, 46.15, 46.17, 241/74, 79, 21, 24; 209/270, 234

[56] References Cited

U.S. PATENT DOCUMENTS

| | | |
|---|---|---|
| 816,446 | 3/1906 | Fiddyment et al. . |
| 1,354,528 | 10/1920 | Wertenbruch . |
| 1,713,507 | 5/1929 | Ammon . |
| 2,141,664 | 12/1938 | Ossing . |
| 2,314,723 | 3/1943 | Mankoff . |
| 2,340,009 | 1/1944 | Meakin . |
| 2,505,674 | 4/1950 | Knight . |
| 2,592,215 | 4/1952 | Wandel . |
| 2,641,165 | 6/1953 | Wandel . |
| 2,699,629 | 1/1955 | Wandel . |
| 2,718,178 | 9/1955 | Wandel . |
| 2,729,145 | 1/1956 | Wandel . |
| 2,729,146 | 1/1956 | Wandel . |
| 3,062,129 | 11/1962 | Wandel . |
| 3,164,329 | 1/1965 | Wandel . |
| 3,170,640 | 2/1965 | Kolts et al. . |
| 3,188,942 | 6/1965 | Wandel . |
| 3,310,241 | 3/1967 | Wandel . |
| 3,319,897 | 5/1967 | Craig et al. . |
| 3,394,649 | 7/1968 | Kemper et al. . |
| 3,482,788 | 12/1969 | Newell . |
| 3,584,800 | 6/1971 | Dodd et al. . |
| 3,620,460 | 11/1971 | Hankes . |
| 3,708,129 | 1/1973 | Nowak . |
| 3,774,853 | 11/1973 | Seifert . . |
| 3,885,745 | 5/1975 | Hankes et al. . |
| 3,917,179 | 11/1975 | Graf . |
| 3,982,703 | 9/1976 | Meyers . |
| 4,032,446 | 6/1977 | Miller, Jr. . |
| 4,074,868 | 2/1978 | Link . |
| 4,109,872 | 8/1978 | Couture . |

(List continued on next page.)

OTHER PUBLICATIONS

Somat brochure entitled "The All New Somat Side--Winder/Waste Disposal Systems by Somat", copyrighted 1976.

Set of 3 drawings of pulping system of item #1 offered for sale about 1976.

(List continued on next page.)

*Primary Examiner*—Douglas D. Watts

*Attorney, Agent, or Firm*—Ratner & Prestia

[57] ABSTRACT

A waste compaction and liquid extraction system is provided. The system includes a tank for containing liquid and solids. The tank has an input port for receiving liquid, and an output port for discharging a mixture of liquid and solids. A rotary disc impeller is mounted in the tank for grinding the solids to form the mixture. The impeller has a rotating blade with inclined and bevelled cutting members. Each cutting member has a helical leading edge. The tank conducts the mixture to the output port. A stationary helical screw is horizontally mounted to the output port of the tank. The screw has a receiving end adjacent to the output port and a discharge end. The screw has a tapered shaft that increases in diameter towards the discharge end. A sieve is provided having a cylindrical sieve surface surrounding the screw. The liquid drains through the sieve surface. The sieve is rotatably mounted to the output port of the tank. The sieve rotates about the screw to move the solids longitudinally towards the discharge end of the screw. A restrictor at the end of the sieve maintains backpressure to squeeze liquid out of the partially dried solids. A housing surrounds the sieve. The housing is mounted to the input port of the tank for communicating liquid that drains from the sieve back to the tank by way of the input port.

36 Claims, 17 Drawing Sheets

U.S. PATENT DOCUMENTS 4,120,457 10/1978 Link .
4,134,555 1/1979 Rosselet .
4,150,617 4/1979 Schramm et al. .
4,155,299 5/1979 Tuttle .
4,222,528 9/1980 Smith .
4,249,701 2/1981 Miller, Jr. .
4,288,254 9/1981 Gladu .
4,365,761 12/1982 Danforth .
4,434,943 3/1984 Deal .
4,454,993 6/1984 Shibata et al. .
4,582,261 4/1986 Perry .
4,621,775 11/1986 Abom et al. .
4,630,780 12/1986 Immel et al. .
4,637,555 1/1987 Furuichi et al. .
4,637,928 1/1987 Zajack, Jr. et al. .
4,640,666 2/1987 Sodergard .
4,651,636 3/1987 Fields .
4,691,867 9/1987 Iwako et al. .
4,697,746 10/1987 Nishimori .
4,778,336 10/1988 Husain .
4,781,823 11/1988 Shinozaki .
4,813,617 3/1989 Knox, Jr. et al. .
4,844,355 7/1989 Kemp, Jr. et al. .
4,911,368 3/1990 Nishimori .
4,941,970 2/1990 Åhs ..... 241/46.17
5,016,825 5/1991 Carpenter .
5,044,566 9/1991 Mitsch .
5,044,809 9/1991 Galanty et al. .
5,129,590 7/1992 Shinya .
5,160,095 11/1992 Pepper .

OTHER PUBLICATIONS

Somat brochure entitled "Foodservice Waste Disposal Systems", copyrighted 1978.

Somat brochure entitled "Somat Document Destruction Systems/Irreversible Disintegration of Sensitive Documents", copyrighted 1985.

Somat brochure entitled "Animal Bedding and Waste Disposal Systems", copyrighted 1985.

Somat brochure entitled "Saving with Somat/How to apply a waste pulping system to your operation", copyrighted 1988.

Somat brochure entitled "Shipboard Food Waste Handling System", copyrighted 1989.

Hobart Brochure entitled "Waste Equipment Systems/-Reduce solid waste problems", printed Jan. 1992.

INTEGRATED WASTE PULPING AND LIQUID EXTRACTION SYSTEM

FIELD OF THE INVENTION

This invention relates to devices for disintegrating solid waste to form a pulp and for extracting water and other liquids from the pulp prior to disposal.

BACKGROUND OF THE INVENTION

Waste reduction systems have been in use for many years. A typical system includes a pulper unit, such as the SP-75S pulper manufactured by the Somat® Corporation of Coatesville, Pa., and a liquid extraction unit, such as the HE-6S Hydra Extractor® unit produced by the same manufacturer.

In a typical pulper system, kitchen waste is placed into a large cylindrical tank that is partially filled with water. A cutting mechanism is typically installed at the bottom of the tank. The cutting mechanism includes a rotating impeller plate with rotating blades that periodically come into play with stationary blades. The rotation of the impeller grinds the waste into a pulp and circulates the water in the tank. Waste particles that are sufficiently small are discharged from the tank and are passed through a conduit to the liquid extraction assembly.

The extraction assembly typically includes a vertical or near vertical feed screw surrounded by a cylindrical screen. The screw rotates at a speed between 85 and 90 revolutions per minute, to advance the solid particles within the pulp vertically towards the top of the extractor. The water within the pulp drains out through the screen due to gravity, and is returned for re-use in the tank. Some systems have included inverted conical restrictor elements at the top (discharge) end, to compress the solid material before discharge for additional liquid removal. The partially dried material at the top of the feed screw is then removed for disposal.

The waste reduction systems developed in the prior art occupy a large footprint and the extractor is typically very tall, often 2 meters in height. The prior art waste handling systems also have been expensive to manufacture (and purchase). Installation often requires technicians to install lengthy conduits between the pulper unit and the extractor unit; the costs for the complex installation often run between 15% and 25% of the purchase cost. In order to improve the footprint, some "close coupled" systems have been developed. These systems have a relatively short distance (e.g., about 30 centimeters) between the pulper and the extractor.

After installation, the prior art systems typically require frequent maintenance by trained personnel after installation. The need for maintenance is particularly acute in two areas of the system: the impeller and the liquid extraction apparatus. Impeller blades have been prone to damage when non-pulpable objects (e.g., metal flatware) become lodged in the blades. Some systems have included replaceable blades, but the blade replacement is a delicate operation requiring a skilled technician. The extractor unit also requires relatively frequent maintenance, to ensure that particles do not clog the openings in the screen or become hardened on the flighting of the screw. Removing the screw and screen is a complex operation also requiring a technician.

The large space requirement and operating costs have typically limited the use of these waste reduction systems to large institutions, such as hospitals, large hotels and cruise ships. The systems have generally not been practical for small institutions (e.g., restaurants) that generate the same types of waste as the large institutions, albeit in smaller quantities. In order to make waste reduction systems available to a greater variety of users, many design changes are required. At the same time that it is desirable to make the unit smaller, it is also desired to improve the accessibility of parts that must be cleaned or serviced. It is desirable to simplify maintenance, so that individuals with comparatively little training can maintain the machine.

SUMMARY OF THE INVENTION

The present invention is a waste pulping and liquid extraction apparatus. The apparatus comprises a tank for containing liquid and solids. The tank has an input port for receiving liquid back from an extraction assembly, and an output port for discharging a mixture of liquid and solids. A rotary disc impeller is mounted in the tank for grinding the solids to form the mixture. The tank conducts the mixture to the output port.

A stationary helical screw is horizontally mounted to the output port of the tank. The screw has a receiving end adjacent to the output port and a discharge end. A sieve is provided having a cylindrical sieve surface surrounding the screw. The liquid drains through the sieve surface. The sieve is rotatably mounted to the output port of the tank. The sieve rotates about the screw to move the solids longitudinally towards the discharge end of the screw.

A housing surrounds the sieve. The housing is mounted to the input port of the tank for communicating liquid that drains from the sieve back to the tank by way of the input port.

DETAILED DESCRIPTION

Overview

Figure 1:
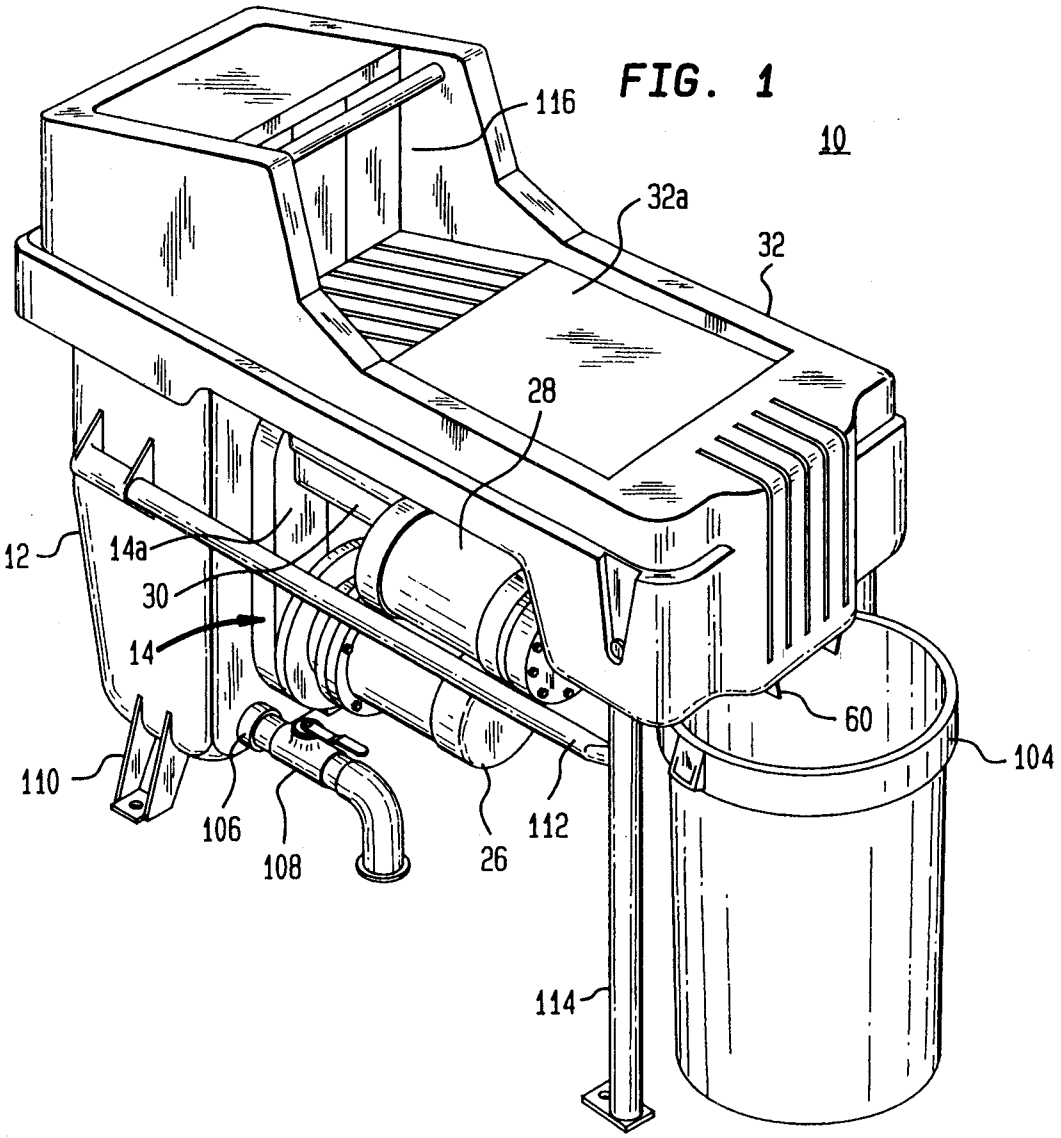
FIG. 1 is an isometric view of an exemplary system according to the invention.

Referring first to FIG. 1, an integrated waste treatment and liquid removal system 10 is shown. The operator of system 10 enters the waste material (e.g. food waste, paper and plastic bags and utensils) on the top surface 32*a* of feed-tray 32. The waste material is pushed through a plurality of hanging splash guard flaps 116, which provide the inlet for receiving solid waste material. Beyond flaps 116 is an opening in the bottom of feed tray 32, through which the waste matter falls into a tank 12. This opening forms the outlet of tray 32 for providing the waste material at the top portion 12*c* (FIG. 2) of tank 12.

The inside of tank 12 is partially filled with water. An impeller assembly 63 (shown in FIG. 2) is attached to a side wall of tank 12. The impeller assembly 63 grinds the waste material into a pulp or slurry. The particles that are ground up to a sufficiently small size pass through the impeller assembly 63 into a chamber 14*a*. The impeller also provides pressure to drive the mixture of liquid and solids up to the top of chamber 14 to an outlet port 20 (shown in FIG. 2) of tank 12. From port 20, the mixture of liquid and solids enters the extraction assembly 31 (shown in FIG. 2 and FIG. 21), contained in a housing 30. In the extraction assembly 31, water is removed from the slurry and returned to tank 12 by way of housing 30. The solid material is extracted and advanced towards the end of extractor 31, where it is expelled from the system at the safety cover 60. The solid material falls into a waste receptacle such as trash can 104. Respective motors 26 and 28 (FIG. 3) are provided for driving the impeller assembly 63 and the extraction assembly 31.

Figure 2:
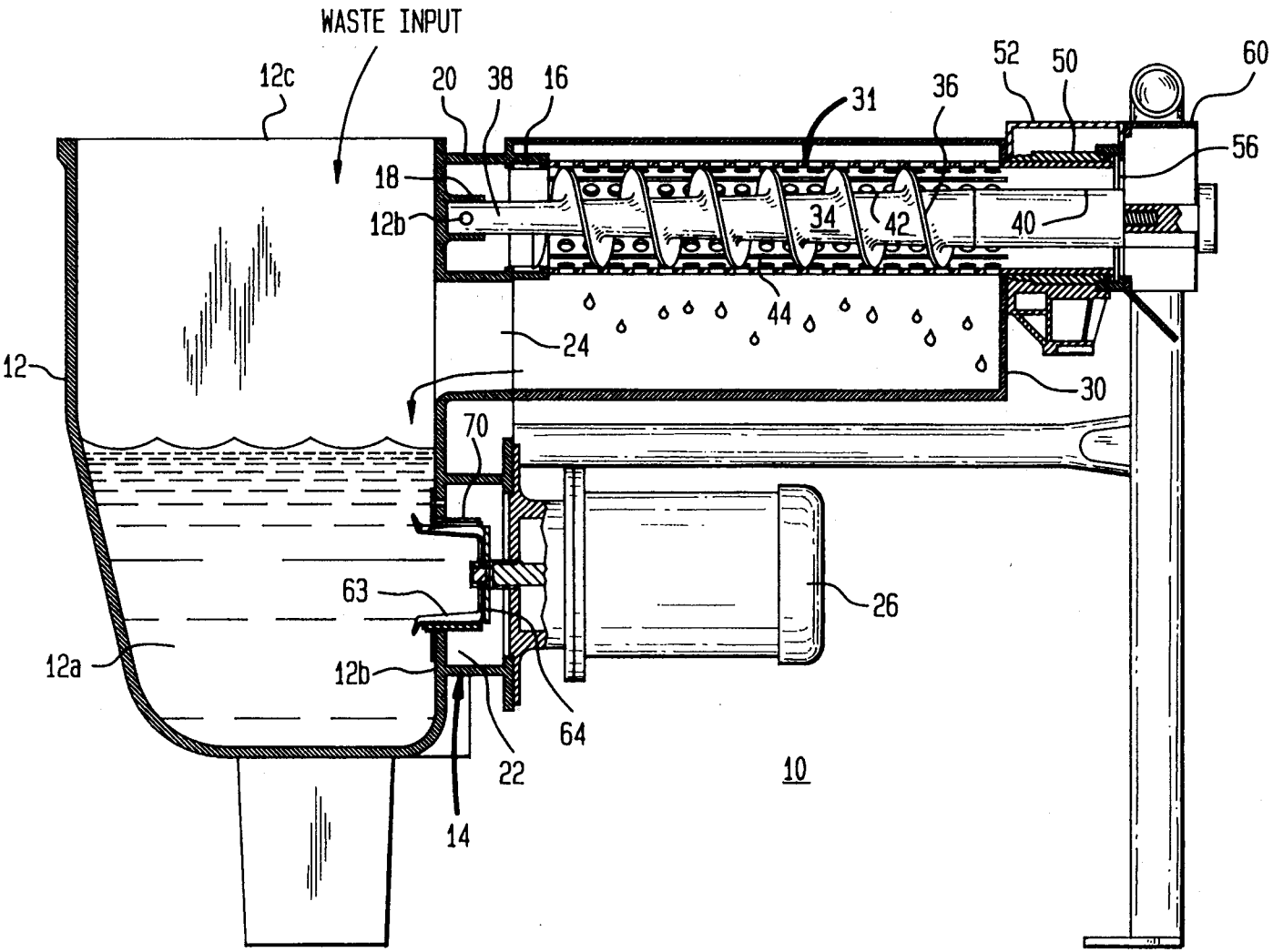
FIG. 2 is a sectional view of the system shown in FIG. 1.

Referring now to FIG. 2, a cross sectional view of the integrated waste treatment and liquid extraction system 10 is shown, with feed tray 32 removed. Waste enters the system at the top 12*c* of tank 12. The waste falls into the water in tank 12. Rotary disk impeller assembly 63 creates turbulence in the water so that the pulpable waste is drawn towards impeller assembly 63. Impeller assembly 63 is mounted on a side wall 12*b* of tank 12. Wall 12*b* separates the integral tank 12 into a main section 12*a* and a chamber 14 (as shown in FIG. 1). The impeller assembly 63 has a sieve ring 70 or security ring, through which small particles of pulp and liquid pass. The driving pressure created by impeller assembly 63 drives the mixture of liquid and solids up to the top of chamber 14 (not shown in FIG. 2), which opens into the outlet port 20 of tank 12.

Outlet port 20 of tank 12 provides a direct connection to the input end 38 or receiving end of the liquid extraction assembly 31. Port 20 also includes respective slidably detachable mountings for the helical screw 34 and for the cylindrical screen 44 of liquid extraction assembly 31. Screw 34 is slidably and non-rotatably mounted in a sleeve 18 within the output port 20 of tank 12. Screen 44 is slidably and rotatably mounted within the port 20.

Figure 3:
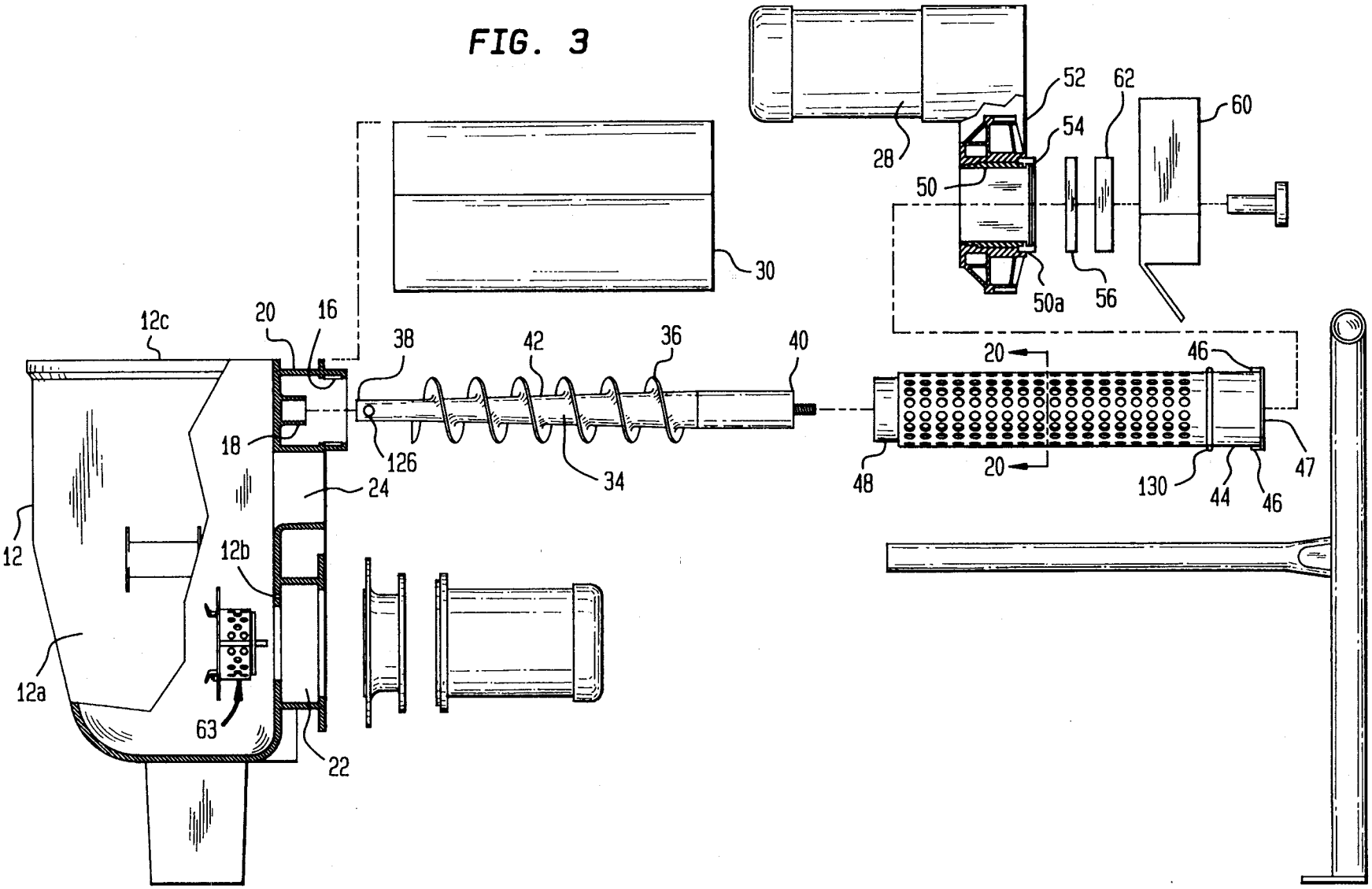
FIG. 3 is an exploded elevation view of the system shown in FIG. 1.

Referring to FIG. 3, at the discharge end 47 of screen 44, a rotating mechanism is provided for engaging the outer peripheral surface of the screen 44, and for rotating screen 44. The mechanism for driving the screen 44 by its peripheral surface includes a rotatable collar 50. Collar 50 includes a detachable mounting for receiving the screen 44 and for transmitting torque to the screen. By this mounting method, both the helical screw 34 and rotating screen 44 may be slidably removed from the apparatus 10, quickly and without the use of any specialized tools. A suitable retaining mechanism such as threaded end nut 62 keeps the screen and screw in place during normal use. When nut 62 is removed, a clear path is provided for removal of the screw 34 and the screen 44. Not only is this procedure quick, it is also simple enough to be performed by nontechnical personnel (e.g., dishwashing or janitorial staff).

Additional aspects of the invention increase the efficiency of liquid extraction assembly 31, to allow reduction in the overall size of system 10. Unlike most extraction systems, extraction assembly 31 is oriented horizontally, and is mounted directly to the pressurized chamber portion 14 of integral tank unit 12. By orienting the screw horizontally, the entire system 10 as shown in FIG. 2, without feed tray 32, can fit below the counter in a typical work area, which is about 78 to 84 centimeters in height. Housing 30 of extraction assembly 31 is also directly mounted onto the chamber 14 of tank 12. Housing 30 serves three purposes: it houses extraction assembly 31, to catch the liquid that is extracted. Housing 31 serves as a return conduit to carry the extracted liquid back to an input port 24 of tank 12. Housing 30 therefore eliminates the need for a separate return conduit to return liquid to the tank 12. And housing 30 provides structural support for the extraction assembly 31, including the motor 28 (shown in FIG. 3) and gearbox 52.

Figure 21:
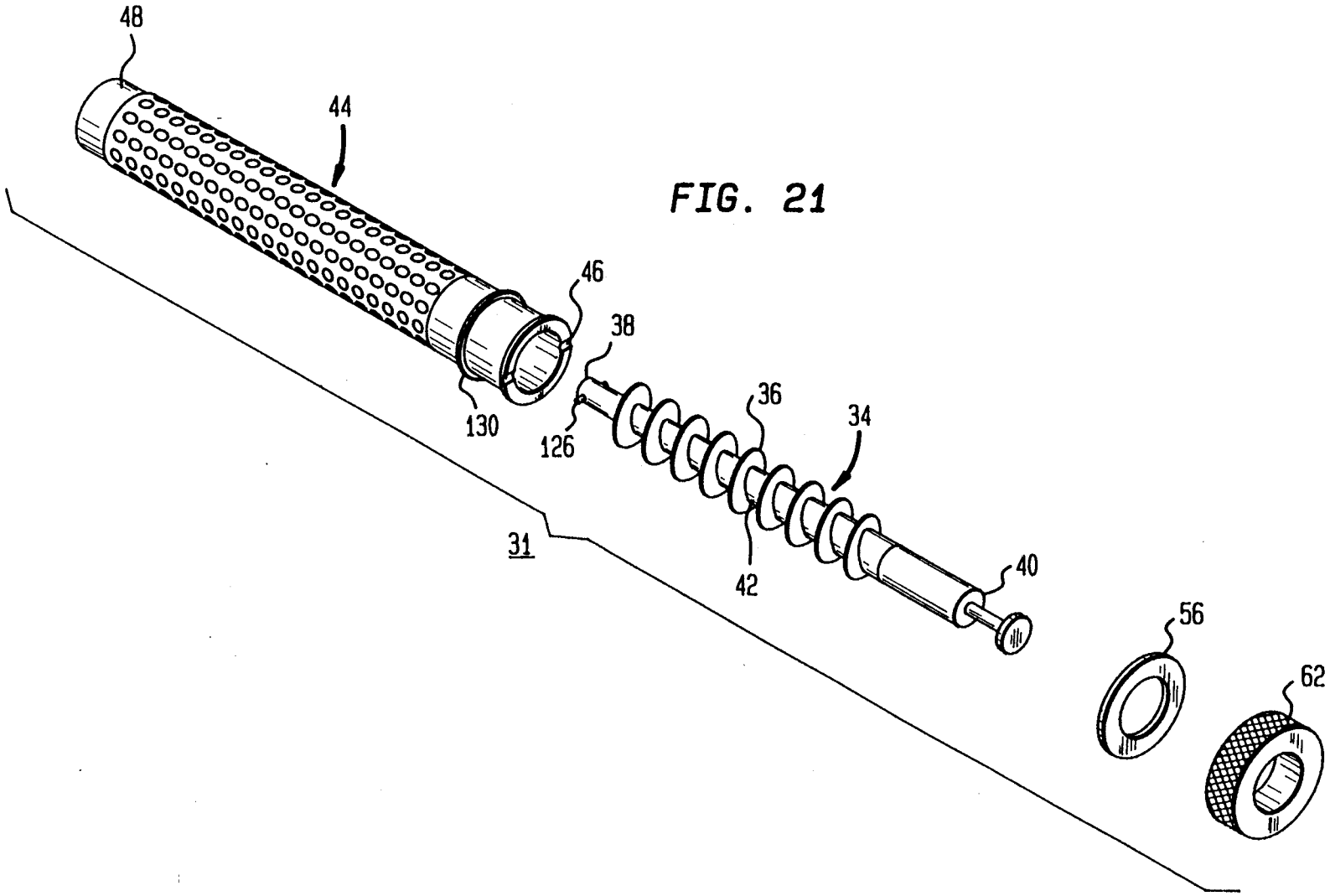
FIG. 21 is an exploded isometric view of the extraction assembly shown in FIG. 3.

In order to reduce the horizontal length of extraction assembly 31, three aspects of the invention improve the water removal efficiency of assembly 31 (shown in exploded view in FIG. 21). The first method is through the use of a tapered screw 34. The shaft 42 of screw 34 is smallest at the input end 38, and continuously increases towards the discharge end 40 of screw 34. The flighting 36 of screw 34 maintains a constant dimension throughout the length of screw 34, as does the sieve surface of extractor sieve 44. Thus, an annular cylindrical region formed between the shaft of screw 34 the flighting 36 and the sieve 44 increases in inner diameter from the input end to the discharge end. This reduces the volume continuously resulting in compression of the partially dried material towards the discharge end. This compression causes additional removal of liquid from the mixture of liquid and solids, to reduce the need for a long extraction assembly 31.

The second aspect of the invention for improving the efficiency of liquid removal is the provision of a restrictor 56 adjacent to the discharge end of extraction assembly 31, for controlling the back pressure in the extraction assembly 31. The restrictor raises the back pressure by retaining the solid material in the extraction assembly 31, so that the solids are compressed further and additional liquid is removed. When the desired pressure is reached, the restrictor opens to allow the partially dried solids to leave the system 10.

A third aspect of the invention further increases the liquid removal efficiency. The inventors have determined that extraction performance has improved and power consumption is reduced when screen 44 is rotated at a speed between 200 and 250 revolutions per minute (RPM), or about two and a half times the rotational speed used in conventional apparatus. At this higher rotational speed, the centrifugal force expelling water through the side surface of the sieve 44 is approximately six times the centrifugal force generated at the lower conventional speed. The use of increased centrifugal force for water removal has an added benefit. The centrifugal force drives the liquid directly in the radial direction, so that liquid removal even takes place close to the shaft of screw 34. This results in more uniform liquid removal from the solid material at varying radial distances from the longitudinal axis of screw 34. This is an improvement over the prior art, in which the slow rotational speed resulted in less water removal closer to the shaft of the screw.

Impeller assembly 63 is placed low in tank 12, so that it is difficult to accidentally contact assembly 63 while tray 32 is assembled on top of system 10 (as shown in FIG. 1), improving safety. With feed tray 32 removed, as shown in FIG. 2, impeller assembly 63 is easily accessed for maintenance, and includes replaceable, quick release stationary blades 72 and rotating blades 76. Replacement of these blades require no special tools or technical training. The removable rotating blades 76 (explained in detail with reference to FIGS. 7–11) also feature anti-jamming features according to additional aspects of the invention. Rotating blade 76 has inclined cutting members 78. Cutting members 78 have beveled leading edges 80. To maintain a desired gap between the different portions of the beveled edge 80 as they come into play with stationary blade 72, beveled edge 80 is formed in a helical shape.

DESCRIPTION OF THE EXEMPLARY EMBODIMENTS

Reference is now made to FIG. 3. FIG. 3 is an exploded view of the system 10. Integrated tank 12 (also shown in a perspective view in FIG. 5), provides the structure on which the remaining components of system 10 are mounted. A wall **12*b* separates tank 12 into a main portion 12*a* (which is filled with water and waste material) and a chamber 14 (shown in FIG. 5) that conducts the pulverized slurry from the impeller assembly 63 to the extraction assembly 31. Wall 12*b* opens into the bottom section 22 of chamber 14. A middle section 14*a* of chamber 14 (shown in FIG. 5) provides a conduit to connect bottom section 22 and port 20 of tank 12. Within the main portion 12*a* of tank 12, the mixture is at atmospheric pressure. The rotating action of impeller assembly 63 provides an increase in pressure that propels the mixture of liquid and ground solids in bottom 22 up the conduit 14*a* to port 20**.

Figure 5:
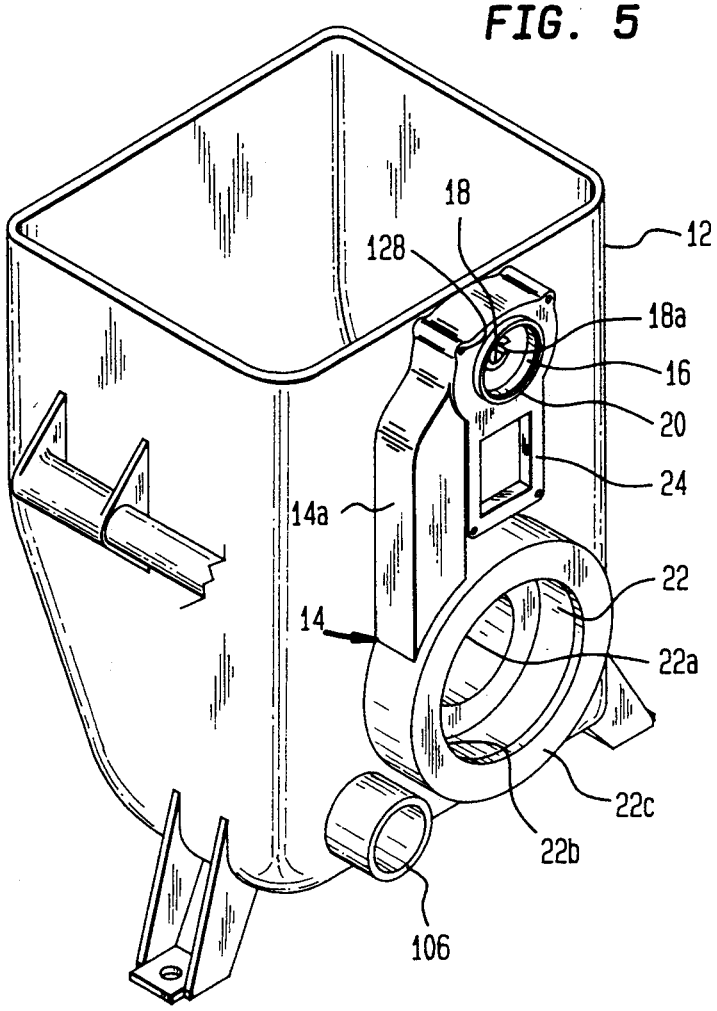
FIG. 5 is an isometric view of the integrated tank of the system shown in FIG. 1.

In the exemplary embodiment, the bottom portion 22 of the chamber 14 has a spiral shape, as best shown in FIG. 5. The radius of the bottom portion 22 increases from a minimum in section **22*a* immediately past conduit 14*a*, to a maximum at section 22*b*, just before conduit 14*a*. With this construction, the fluid rotating around bottom chamber 22 maintains a substantially constant flow velocity. This prevents stagnation from occurring in chamber 22 and enhances the pumping capability of impeller assembly 63**.

The top of conduit **14*a* opens into an output port 20 onto which the extraction assembly 31 is mounted. An inner sleeve 18 slidably receives the input end 38 of helical screw 34. In the exemplary embodiment, sleeve 18 includes two horizontal slots 18*a* (shown in FIG. 5) for receiving a dowel pin 126 that is mounted transversely at the receiving end of screw 34. The slot 18*a* and pin 126 arrangement prevents rotational movement of screw 34, while absorbing axial loading on screw 34 in the direction of tank 12. This allows for easy sliding removal of screw 34. Screw 34 is thus detachably mounted in sleeve 18**.

It is understood by one skilled in the art that other torque reaction mechanisms such as a slot and tab arrangement may be used. For example, end 38 may be formed into a tab (not shown) that fits into a slot (not shown) in port 20.

Near the opening of port 20, a bushing 16 is mounted for slidably receiving the input end 48 of sieve 44 (FIG. 3). In the exemplary embodiment bushing 16 is formed of an ultra high molecular weight polyethylene. Bushing 16 acts as a self lubricating bearing, reducing friction as sieve 44 rotates, regardless of whether bushing 16 is wet or dry. Bushing 16 may also have a longitudinal slot so that it may easily be twisted and pried out for replacement if necessary.

The extraction assembly 31 is cantilever mounted to port 20 of integral tank 12. In addition to the slidable couplings of screw 34 and sieve 44 to the port 20, a mechanical coupling is also provided for housing 30. Exemplary housing 30 is bolted to suitable mating bolt holes 128 on tank 12, as shown in FIG. 5. Referring again to FIG. 3, a suitably shaped gasket (not shown) is placed between housing 30 and the surface of port 20 of tank 12, to provide a positive water tight seal. At the other end of housing 30, the rotating mechanism is cantilever mounted to the discharge end of housing 30.

Figure 20:
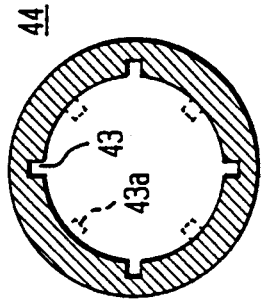
FIG. 20 is a cross sectional view of the sieve shown in FIG. 3.

In the exemplary embodiment, screen 44 is a perforated tube. On the inside of the sieve surface 44 a plurality of longitudinal grooves 43 may be provided (best seen in FIG. 20) extending from input end 48 to end of flighting 36. Note that the wall thickness of sieve 44 is exaggerated in FIG. 20 to more clearly show the grooves 43. The longitudinal grooves 43 assist in moving the solids in sieve 44 in the longitudinal direction towards discharge end 46 when sieve 44 rotates. Grooves 43 also reduce movement of the solids in the tangential direction relative to sieve 44.

It is desirable for the rotational speed of the solids to approximate the rotational speed of sieve 44. Pushing the solids in the longitudinal direction helps squeeze the liquid out of the solids, but movement in the tangential direction is not effective to remove additional liquid. Also, movement in the tangential direction increases friction between the solids and the sieve, causing heating, which may be undesirable. Friction between the solids and sieve 44 is minimized if the solids move longitudinally relative to sieve 44, but not in the tangential (transverse) direction relative to sieve 44.

Figure 17:
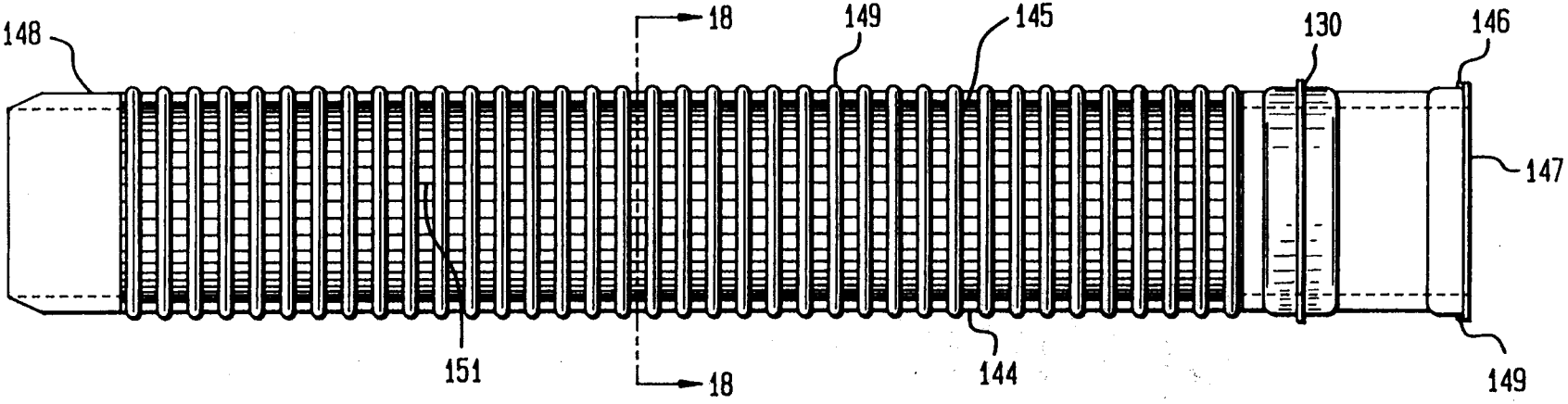
FIG. 17 is a side elevation view of an alternate embodiment of the sieve shown in FIG. 3.
Figure 19:
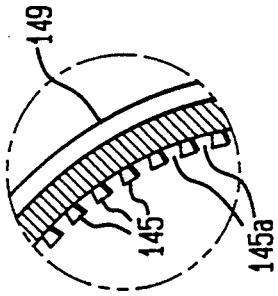
FIG. 19 is an enlarged feature of the sieve shown in FIG. 18.
Figure 18:
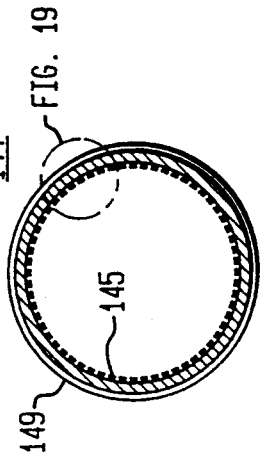
FIG. 18 is a cross sectional view of the sieve shown in FIG. 17.

It is understood by one skilled in the art that sieve 44 may be constructed with a variety of variations from the exemplary configuration. For example, instead of using longitudinal grooves, longitudinal lands 43*a* (shown in phantom in FIG. 20) may be used for a similar purpose. Alternatively, instead of a perforated tube, a wedgewire sieve 144 (shown in FIGS. 17–19) may be used. Wedgewire sieve 144 is constructed of a plurality of inner longitudinal wire strands 145 bound together by a plurality of spaced circular outer wire strands 149. (Alternately, the plurality of circular outer strands 149 may be replaced by a helically wound outer wire, not shown). A plurality of substantially rectangular holes 151 are formed between the strands 145 to allow liquid to drain out. A plurality of longitudinal channels 145*a* are formed between pair of adjacent longitudinal strands 145.

Referring again to FIG, 3, in the exemplary embodiment the rotating mechanism includes a gear box 52 to which a motor 28 is mounted. Motor 28 is coupled via gears to a collar 50 inside gearbox 52. Collar 50 surrounds the periphery of sieve 44 at its discharge end 47. Collar 50 includes an arrangement of slots 50*a* that are adapted to receive a plurality of mating keys 46. Keys 46 are integrally attached to the discharge end 47 of sieve 44. Keys 46 are slidably received by slots 50*a* when sieve 44 is slid through collar 50, through the length of housing 30, and into bushing 16 of port 20. The slot 50*a* and key 46 arrangement provides positive mechanism for transmitting torque from mounting collar 50 to sieve 44 for rotating the sieve.

It is understood by one skilled in the art that the rotating mechanism may include other mechanical transmissions for transmitting torque from motor 28 to sieve 44. For example, instead of a gear box 52, a belt drive transmission may be used. The belt may be coupled to a collar such as collar 50, or the belt may be directly coupled to the outer periphery of the sieve 44.

A suitable seal, such as O-ring seal 130 is placed on the periphery of sieve 44 near the discharge end 47, to provide a positive water tight seal between the sieve 44 and the collar 50.

Once screw 34 and sieve 44 are in position, a retaining nut 62 is applied to hold sieve 44 in place. In the exemplary embodiment, the retaining nut 62 has a large acme screw thread and a knurled outer surface, so that nut 62 may be easily installed or removed by hand without the use of any tools. Other than retaining nut and feed tray 62, no components or objects mechanically block the path for removing screw 34 or screen 44. Periodic maintenance of these components (e.g., weekly cleaning) may be performed by removing feed tray 32, then removing the retaining nut 62 and sliding screw 34 and sieve 44 out. Additionally, retaining nut 62 transmits the axial load of sieve 44 to the mechanical transmission (e.g., by way of collar 50).

The benefit of using a rotating screen 44 and stationary screw 34 is in the simplification of the system 10 design while maintaining easy removal for the screw 34 and screen 44. With screw 34 and screen 44 cantilever mounted from port 20 of tank 12, and screen 44 driven at its periphery by rotating mechanism 28, 50 and 52, screw 34 and screen 44 are easily removed through the discharge end. Motor 28 and gearbox 52 are easily isolated from the liquid inside screen 44.

In an alternative embodiment (not shown), the screw 34 could rotate and the screen 44 could be held stationary. In such a configuration, screw 34 would have to be driven at receiving end 38 so as not to block egress of solids from discharge end 40. To drive screw 34 from receiving end 38, rotating mechanism 28, 52 would have to be positioned inside tank 12, near tank opening 12*c*. This would require motor 28 and gearbox 52 to be able to withstand the wet and corrosive environment of tank 12. Although this alternative embodiment is technically feasible, the exemplary embodiment is simpler and less expensive to construct.

Figure 4:
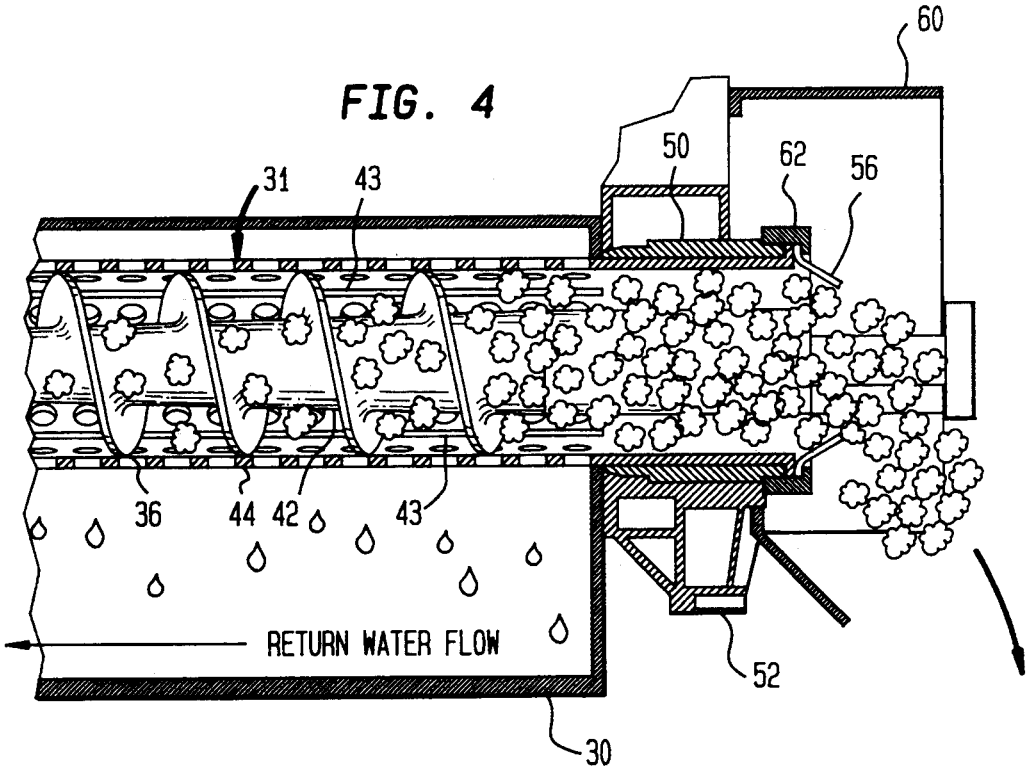
FIG. 4 is a detailed sectional view of the discharge end of the extraction system of the system shown in FIG. 2.

Referring now to FIG. 4, retaining nut 62 also includes an annular groove for receiving a restrictor ring 56. Exemplary restrictor ring 56 is a flat annular ring formed of cast polyurethane (as best seen in FIG. 21). The material is suitably flexible, and may be approximately 80 durometer Shore-A scale. The outer diameter of restrictor 56 is sized to fit over the discharge end 47 of sieve 44 in a tight sealing relationship. The inner diameter of restrictor 56 is approximately the diameter of discharge end 40 of screw 34. Thus, restrictor ring 56 forms a seal extending radially from discharge end 40 to sieve 44.

During start up of system 10, restrictor ring 56 maintains its substantially flat shape and substantially seals the end of extraction assembly 31, preventing water from being expelled out the discharge end of extraction assembly 31. Instead, liquid is expelled from the side surface of sieve 44 as shown in FIG. 4. Over time an increasing amount of solid material accumulates between the discharge end 40 of screw 34 and the discharge end 47 of sieve 44. At first, restrictor 56 continues to maintain its flat shape, increasing the back pressure and compressing the solid matter at the discharge end. Gradually, as the back pressure increases, restrictor ring 56 flexes and opens up allowing the solids to be discharged from assembly 31, as shown in FIG. 4.

Restrictor 56 provides an effective and adaptive mechanism for controlling the back pressure in the discharge end of extractor assembly 31. Because it seats inside of retaining nut 62, restrictor 56 is also easily removed and replaced during maintenance. It will be understood by one skilled in the art that by varying restrictor 56, the dryness of the solid material discharged from extractor assembly 31 may be varied. For example, by using a stiffer material, or by providing restrictor ring 56 with a smaller inner diameter, the back pressure in the discharge end of extraction assembly 31 is increased, and the dryness of the solid material discharged from the system is increased (i.e., more water is expelled through the side surface of sieve 44).

Referring again to FIG. 3, a suitable safety cover 60 is attached to gear box 52. Safety hood 60 prevents accidental contact between a worker and extraction assembly 31. There are no large protuberances within reach. All rotating elements 50, 56, 62 are relatively smooth and safe from accidental contact.

An added benefit of the high rotational speed of sieve 44 is that the solid matter discharged from extractor assembly 31 tends to break off more readily without the need for a "cake cutting" apparatus at the discharge end 47. Although FIG. 4 shows solid material (e.g., wet food waste) being discharged in discrete pieces, some materials (such as relatively dry waste composed predominantly of paper) may be "extruded" from extraction assembly 31 in the form of a cylindrical shell or cake. The inner diameter of the cylindrical shell is approximately the diameter of screw discharge end 40 and the outer diameter is the diameter of sieve 44. In prior art systems, a cake cutter was used to break up the cylindrical shell into small pieces for disposal.

Using a high rotational speed according to the invention, if the solids form a cylindrical shell, the shell tends to droop from the pull of gravity as it extends further from discharge end 47. Once the cake shifts away from the longitudinal axis of extraction assembly 31 under the pull of gravity, the high centrifugal force from the rapidly rotating sieve 44 causes the "cake" to rapidly twist off and fall. Eliminating the need for a sharp cake cutter provides an advantage in terms of safety, because the discharge end is in a position that can be accessed by personnel.

Table 1 shows how the power consumption, discharge rate (of partially dried solids) and percent solids in the discharged material varied as a function of the rotational speed of the screen in an exemplary apparatus as described above.

TABLE 1

| RPM | HORSEPOWER | LB./HR. | % DRY |
|---|---|---|---|
| 198 | 2.87 | 155 | 37 |
| 242 | 3.19 | 158 | 37 |
| 283 | 3.59 | 173 | 39 |
| 340 | 4.39 | 180 | 38 |
| 382 | 3.18 | 123 | 43 |

As shown in table 1, the power consumption is fairly flat from about 200 RPM to about 250. Although power consumption and percent dryness are both favorable at 382 RPM, there is a significant decrease in the discharge rate that substantially reduces the system throughput.

Figure 7:
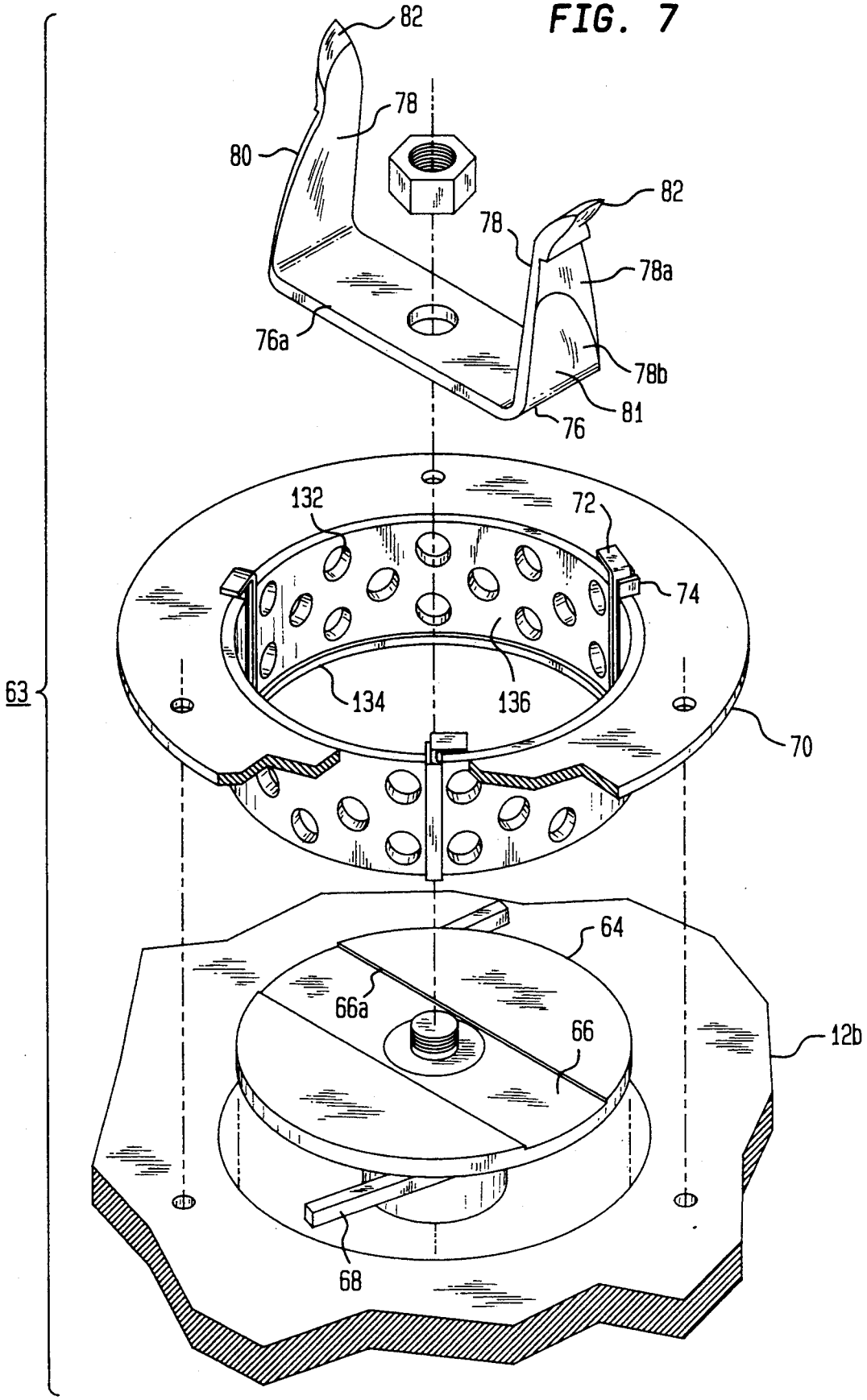
FIG. 7 is an exploded isometric view of the impeller assembly shown in FIG. 3.

Referring now to FIG. 7, the impeller assembly 63 is shown in an exploded perspective view. Impeller assembly 63 is designed to avoid blade damage through a blade configuration that avoids jamming of nonpulpable items such as flatware, Additionally impeller assembly 63 provides for a quick replacement of blades without specialized tools when replacement is necessary.

FIGS. 7, 8*b* and 9–13 show the exemplary impeller assembly 63. Referring first to FIG. 7, impeller assembly 63 includes a security ring or sieve ring 70 that attaches to the side wall 12*b* of integral tank 12. Sieve ring 70 includes a cylindrical sieve surface 136 that has a plurality of holes 132. The holes 132 are sized to retain the solid materials within the main portion of tank 12 until the solids are ground down to a small enough particle size to pass through the holes 132. An annular ring 134 is integrally attached to sieve ring 70, for retaining the stationary blade cutting member 72 as described in detail below with reference to FIGS. 9 and 10. A plurality of stationary blade holders 74 are integrally attached to the inner sieve surface 136. The blade holders 74 are also described with reference to FIG. 10.

A rotating disk impeller plate 64 is attached to the rotating shaft of motor 26 as best seen in FIG. 2. Impeller plate 64 includes two important features. The first distinguishing feature is a channel 66 for receiving a removable rotatable impeller blade assembly 76. Removable assembly 76 simplifies maintenance, because it is not necessary to replace the entire impeller plate 64 if a cutting edge 80 (FIG. 7) of assembly 76 is damaged in any way. Furthermore the side walls 66*a* of channel 66 provide a positive mechanical coupling for transmitting torque to the rotating blade assembly 76.

A second aspect of impeller disk 64 is the configuration of the impeller pumping ears 68. In typical impeller disks of the prior art such as disk 164 (shown in FIG. 8*a*), the impeller pumping ears 168 are aligned in the radial direction. In accordance with the invention however impeller pumping ears 68 are not aligned in the radial direction. In the exemplary embodiment, ears 68 are neither aligned radially nor in a direction that is tangential to the impeller disk 64. In the exemplary embodiment, the angle between impeller ear 68 and disk 64 is defined by angle 68*a*, and is approximately 45 degrees. By aligning impeller ears 68 at an angle 68*a* that is substantially less than 90 degrees, stringy pulped items (e.g., strips of plastic) are more likely to slide off of ears 68. These stringy items are less likely to become entangled on impeller pumping ears 68 and thereby contribute to power consumption imbalance and restriction to flow within chamber 22.

Impeller assembly 63 includes a rotating blade assembly 76 and a stationary blade assembly 72, 74 that are each tailored to support maintainability and reliability. Rotating blade assembly 76 includes a plurality of shearing members 78 that are integrally attached to a base member 76*a*. To enhance cutting performance, the shearing members 78 are not perpendicular to the base member 76*a*. Shearing members 78 are inclined towards the inner surface 136 of the sieve ring 70. In the exemplary embodiment, shearing members are inclined at an angle of approximately 6 degrees from the longitudinal axis of sieve ring 70. That is, angle 76*b* (shown in FIG. 13) is approximately 96 degrees. This allows the leading edge 80 of blade 78 to be helically formed to permit close clearances between shearing members 78 and stationary blade 72. Shearing members 78 also include a bevelled cutting edge 80 that periodically comes into play with non-rotating blade member 72. In the exemplary embodiment, leading edge 80 is bevelled at an angle 76*c* (shown in FIG. 12) of approximately 32 degrees from the longitudinal axis of sieve ring 70. This bevel angle serves to deflect nonpulpable items from the blade assembly to reduce likelihood of jamming. Angle 78*c* may be varied between 30 and 60 degrees ejection of non-pulpable items.

Figure 8A:
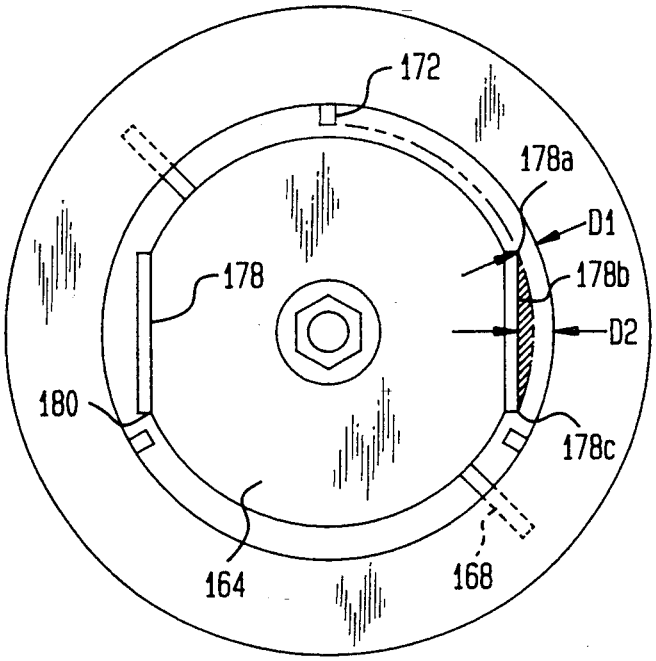
FIG. 8A (PRIOR ART)
FIG. 8*a* is a plan view of a prior art impeller assembly.
Figure 8B:
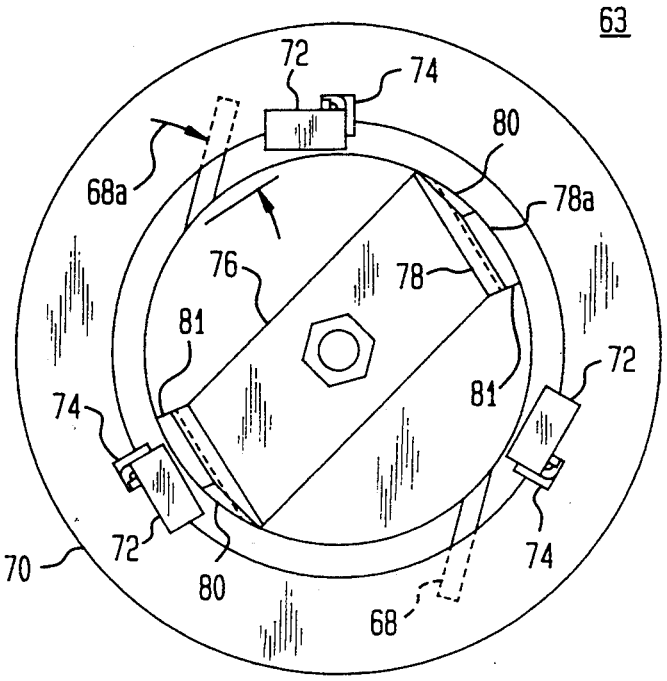
FIG. 8*b* is a plan view of the impeller assembly shown in FIG. 3.
Figure 11:
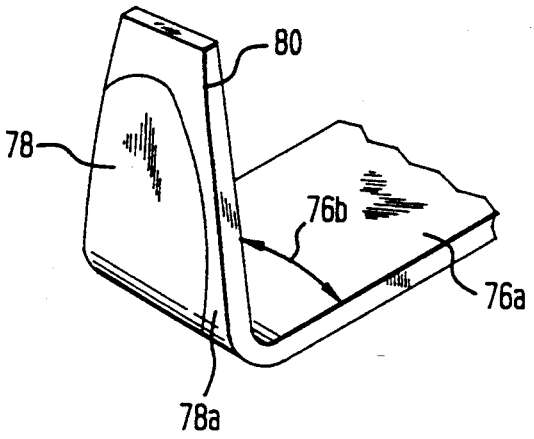
FIG. 11 is an isometric view of a the helical leading edge of the rotating blade assembly shown in FIG. 7.
Figure 13:
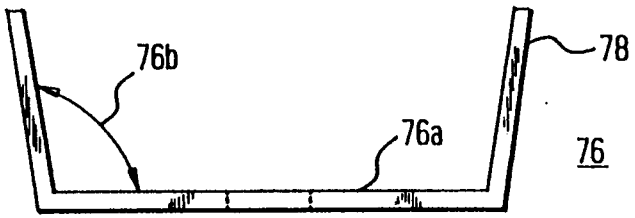
FIG. 13 is a front elevation view of the rotating blade shown in FIG. 12, after bending.
Figure 12:
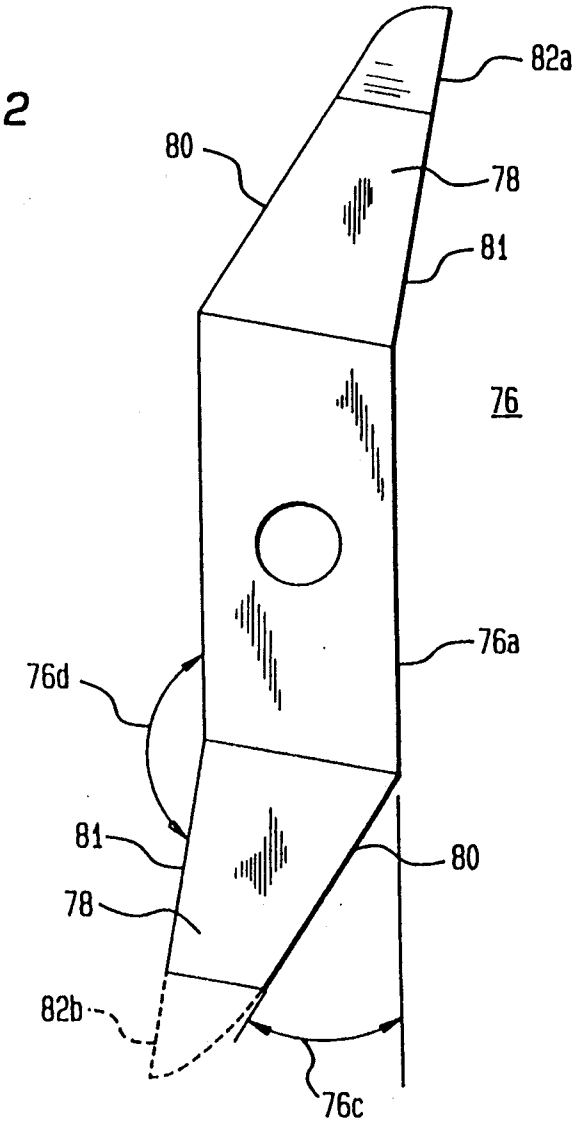
FIG. 12 is a plan view of the rotating blade shown in FIG. 7, prior to bending.

As shown in FIGS. 7, 8*b* and 11, the outer edge of members 78 are substantially constant in radial dimension. This is best seen in FIG. 8*b*, which is a plan view of blade assembly 76, In the exemplary embodiment, blade assembly is formed from flat stock as shown in FIG. 12. The two cutting members are bent as shown in FIG. 13. The outer surface 78*a* of inclined shearing member 78 is then ground to be substantially cylindrical in shape, as shown in FIG. 8*b*. Thus lead cutting edge 80 is inclined to match the inclination angle 76*b* of member 78, and bevelled to match the bevel angle 76*c* of the front of member 78 with a substantially constant radius. This configuration results in a helical shape for member 80 as best seen in FIG. 11.

The advantage of the helical cutting edge 80 as compared with prior art blades is best shown by comparing rotating blade assembly 76 as shown in FIG. 8*b* with the prior art shown in FIG. 8*a*. FIG. 8*a* shows a conventional bevelled and inclined blade 178 that has a flat leading edge. The radial distance between blade 178 and stationary blade 172 varies along the length of the bevelled edge. This radial distance is smallest at the bottom 178*a* of rotating blade 178 and at the top 178*c*. The distance between the rotating and stationary blades is greatest approximately midway between the bottom and the top of rotating blade 178.

As shown in FIG. 8*b* the helical lead cutting edge 80 allows the inclined and bevelled sheering member 78 to maintain a substantially constant radial distance between cutting edge 80 and the stationary cutting member 72.

Another aspect of the rotating blade assembly 76 is the trailing edge 81. In the exemplary embodiment, trailing edge 81 is formed at an angle 76*d* of approximately 167 degrees from member 76*a*. The inventors believe that the combination of beveled leading edge 80 and beveled trailing edge 81 result in the formation of a localized low pressure region just behind trailing edge 81. During testing of an impeller assembly 63 as shown in FIG. 7, stringy pulped items, such as plastic straws were pulled back into the main portion 12*a* of tank 12. In prior art systems, these stringy items would often stick party way through the holes 132 of sieve ring 136. It is believed that low pressure behind trailing edge 81 resulted in the non-pulpable items being released from the holes 132. This low pressure region is believed to be small, because the overall direction of pulp flow is from main tank portion 12*a* to chamber bottom 22.

Figure 9:
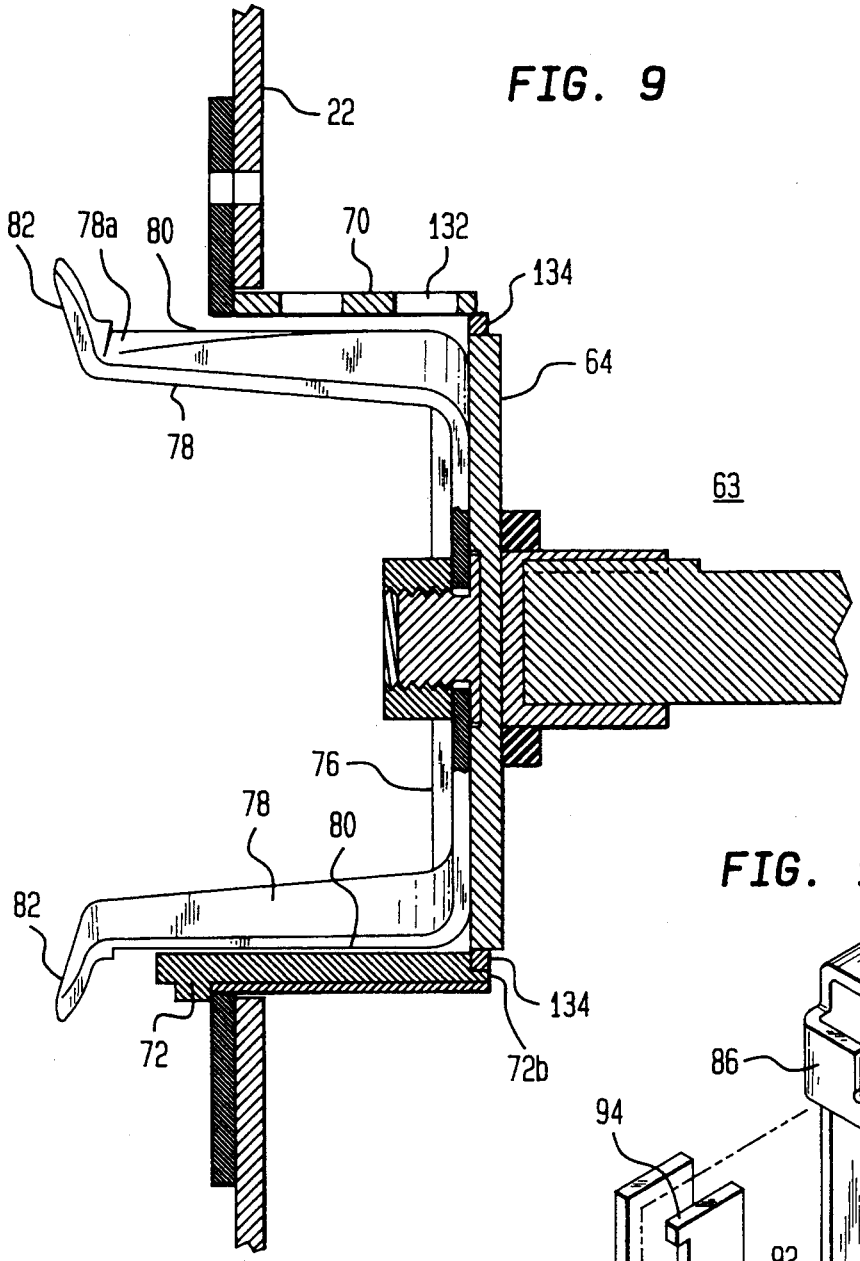
FIG. 9 is a detailed sectional view of the impeller assembly shown in FIG. 3.

As shown in FIGS. 7 and 9, rotating blade 76 may include an optional ear 82 at the end of each shearing member 78. The ears 82 increase the turbulence in tank 12. The ears also help to submerge floating objects (e.g., milk cartons), so that they are pulped.

Figure 10:
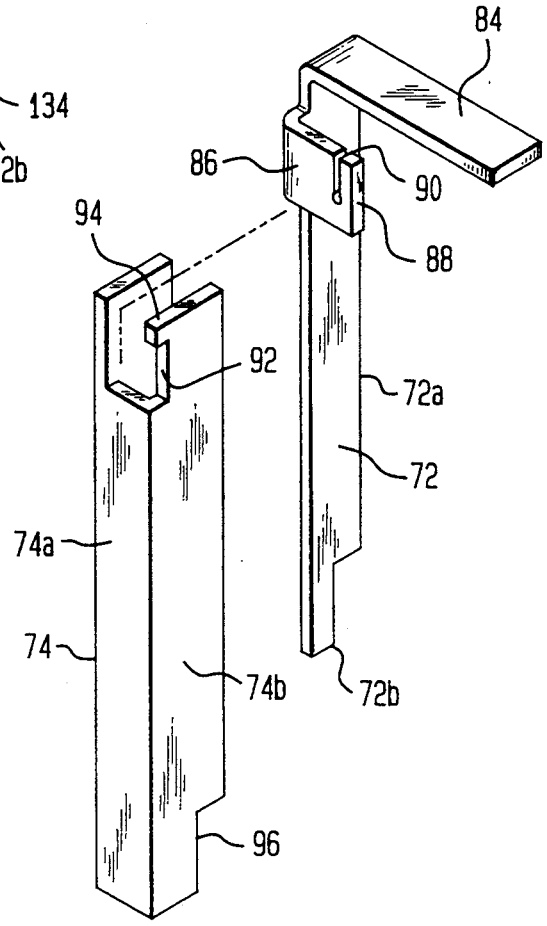
FIG. 10 is an exploded rear isometric view of the stationary blade assembly shown in FIG. 7.

Referring now to FIG. 10, a perspective view of the stationary blade assembly 72, 74 is shown. The stationary blade assembly includes a blade holder 74 that is integrally mounted to the inside surface 136 of sieve ring 70. Blade holder 74 is substantially in the form of a channel having a base member 74*a* and two side members 74*b*. At the end of blade holder 74 nearest to impeller disk 64, a cut out 96 in the form of a notch is provided, so that blade holder 74 conforms to the bottom ring 134 of sieve ring 70, as best shown in FIG. 9. Base member 74*a* is integrally attached to surface 136, for example, by TIG welding or casting.

Referring again to FIG. 10, at the other end of blade holder 74, another cut out 92 is provided on base member 74*a*. A retaining member 94 is provided on one of the side members 74*b*. Cut out 92 is provided to receive a retaining tab 88 on the removable blade 72.

Detachable cutting member 72 includes a cutting surface 72*a*. In the exemplary embodiment, cutting edge 72*a* is substantially straight and substantially square. Cutting member 72 is held in place on blade holder 74 by three features. At one end 72*b* of cutting member 72, member 72 rests against bottom ring 134 of sieve ring 70, preventing radial motion at end 72*b* of cutting member 72. Near the other end of cutting member 72 a retaining tab 86 is provided. In the exemplary embodiment retaining tab 86 is substantially rectangular, with a longitudinal slot 90 dividing tab 86 into a main portion and an end portion 88. End portion 88 fits in slot 92 behind side member 74*b*.

In order to mount cutting member 72 in blade holder 74, end member 88 is bent back as it is slipped down over abutment 94 of blade holder 74. Once in place, end member 88 snaps back to its original straight shape and lines up in slot 92 beneath abutment 94. Thus side member 74*b* prevents radial motion of the lower portion of end member 88, thereby preventing radial motion of the top portion of cutting member 72. At the same time, abutment 94 prevents longitudinal motion of end member 88 so that cutting member 72 cannot move in the longitudinal direction, i.e. the direction of the shaft of motor 26. Cutting member 72 also includes a handle 84 for ease of insertion into and removal from blade holder 74. Preferably tab 86 is of a material and thickness that is flexible enough so that member 88 may be easily bent with a simple tool such as a kitchen knife or screwdriver for removal from blade holder 74.

It is understood by one skilled in the art that a variety of different fastening methods may be used to hold removable blade 72 in place. For example, holes (not shown) may be provided in the side members of blade holders 74*b* and in cutting member 72. A suitable pin (not shown) may be placed through these holes and held in place by a retaining mechanism such as a clip or an O-ring. If such a pin is used, then it is not necessary to include slot 90 or abutment 94, and it is not necessary to bend back a portion of the tab 86 during insertion. The pin prevents longitudinal motion.

Figure 14:
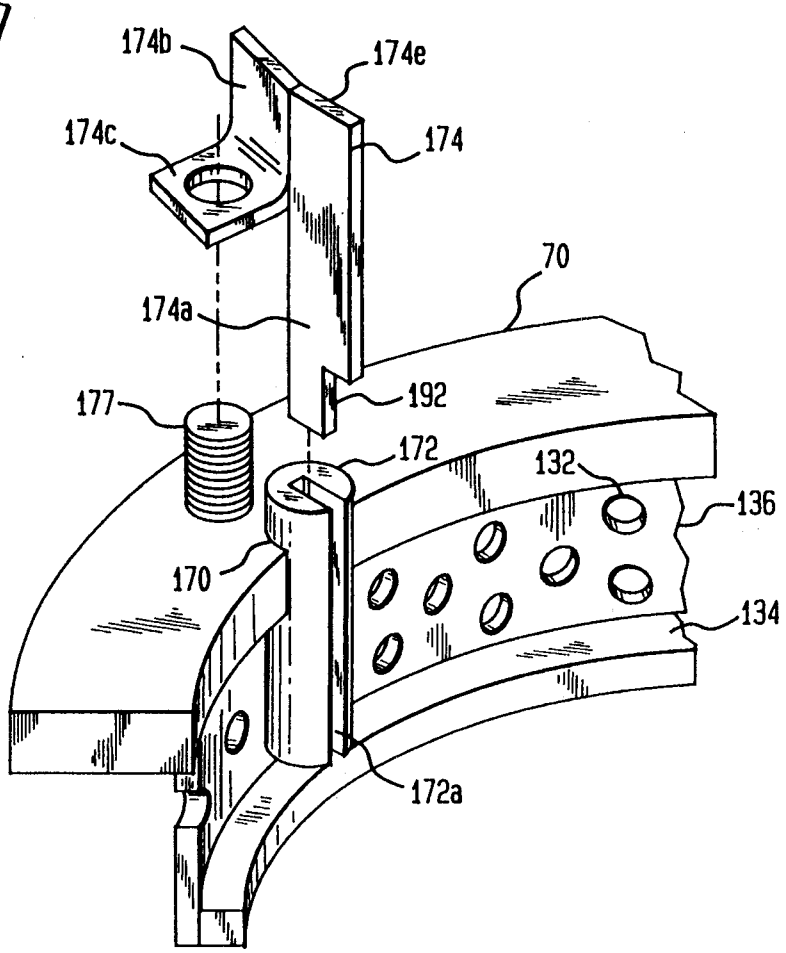
FIG. 14 is an isometric view of a portion of the sieve ring shown in FIG. 7, including a second exemplary embodiment of the stationary blade.
Figure 15:
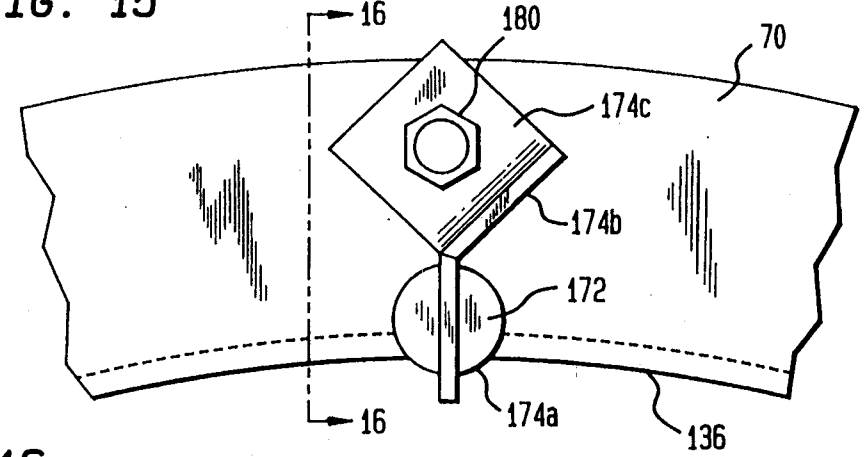
FIG. 15 ms a plan view of the stationary blade shown in FIG. 14.
Figure 16:
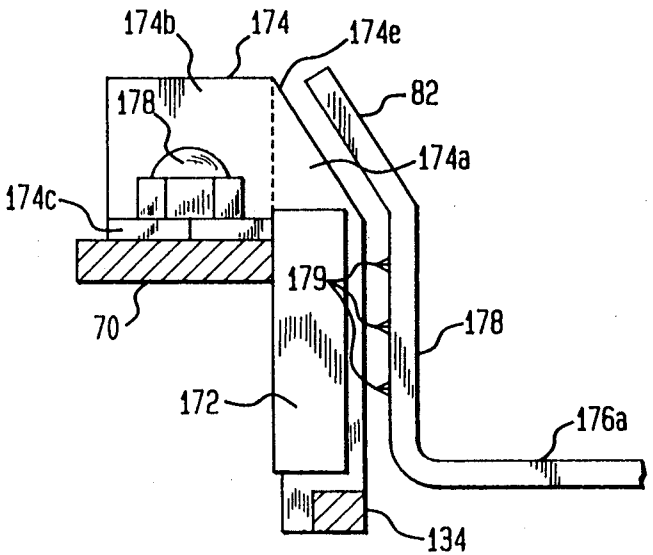
FIG. 16 is a cross-section of the sieve ring shown in FIG. 14.

FIGS. 14–16 show a further exemplary embodiment of the stationary blade assembly that may be used in impeller assembly 63. FIG. 14 is an isometric view of a portion of sieve ring 70, including a blade holder 172 and blade 174. Blade holder 172 is generally cylindrical in shape, and has a longitudinal notch 172*a* for receiving blade 174. This shape may have manufacturing advantages. For example, if blade holder 172 is provided as a separate part from sieve ring 170, then a cylindrical hole 170 in sieve ring 70 is formed to receive blade holder 172. It is simpler to form such a cylindrical hole 170 (e.g., using an end mill), than it is to form a substantially rectangular hole to receive the blade holder 74 shown in FIG. 10.

Removable blade 174 has a straight cutting edge for coming into play with the helical edge 80 of rotating blade 176. Additionally, a diagonal cutting edge 174*e* is provided at the top of blade 174. Diagonal edge 174*e* comes into play with ears 82 of rotating blade 176. The combination of diagonal edge 174*e* and rotating blade ears 82 provide an action to deflect materials to the interior section 12*a* of tank 12.

Removable blade 174 may be formed from a flat metal blank. The blank has three portions: a cutting portion 174*a* and two rectangular portions 174*b* and 174*c*. The blank is bent between portions 174*a* and 174*b*, and between portions 174*b* and 174*c*. Portion 174*b* is in a vertical plane approximately 45 degrees from the plane of portion 174*a*. Portion 174*c* is bent to be perpendicular to portion 174*b*, in a horizontal plane. Portion 174*c* provides a mounting to attach removable blade 174 to sieve ring 70. In the exemplary embodiment, as shown in FIG. 14, a mounting stud 177 is provided for attaching removable blade 174. A conventional nut 180 can then hold the removable blade 174 in place.

Variations of the rotating blade assembly, such as blade 176 are also contemplated. In the embodiment of the rotating blade 176 shown in FIG. 16, one or more cutters 179 are positioned near the trailing edge 81 of the cutting members 78. Each cutter 179 may be shaped like a half pyramid, with the axis of the pyramid oriented in the tangential direction (i.e., orthogonal to the longitudinal axis and of the impeller assembly and orthogonal to the radial direction). The apex of each cutter points towards the leading edge of the cutting members 178 of the rotating blade assembly 176. The cutters 179 are small enough so that they do not bridge the gap between cutting members 178 and the sieve surface 136 of sieve ring 70. The cutters 179 provide an additional facility to cut and dislodge material vacuumed from screen surface (e.g. plastic straws) that may become captured between the rotating blade 176 and the sieve surface 136.

Figure 22:
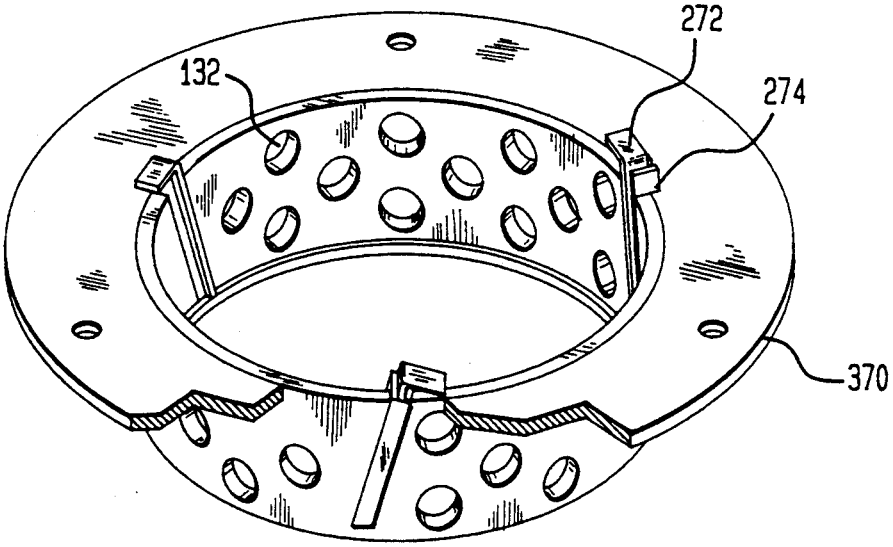
FIG. 22 is an isometric view of a further exemplary embodiment of the sieve ring shown in FIG. 7.
Figure 23:
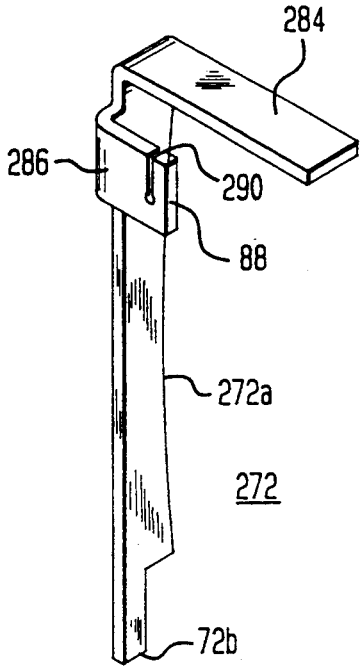
FIG. 23 is an isometric view of the stationary blade shown in FIG. 22.

FIG. 22 shows a variation of the sieve ring. Sieve ring 270 is the same as ring 70, except that the blade holders 274 are not aligned in the longitudinal direction. Blade holders 274 are bevelled in the tangential direction. A stationary blade 272 (best seen in FIG. 23) is used that is the same as blade 72, except that blade 272 has a helical edge 272*a*. When blade 272 is mounted in blade holder 274, helical edge 272*a* has a constant radius. By using bevelled blade holders 274 and blades 272, the total bevel angle between the rotating blade leading edge 80 and the stationary blade edge 272*a* is increased. This enhances ejection of non-pulpable items.

Figure 24:
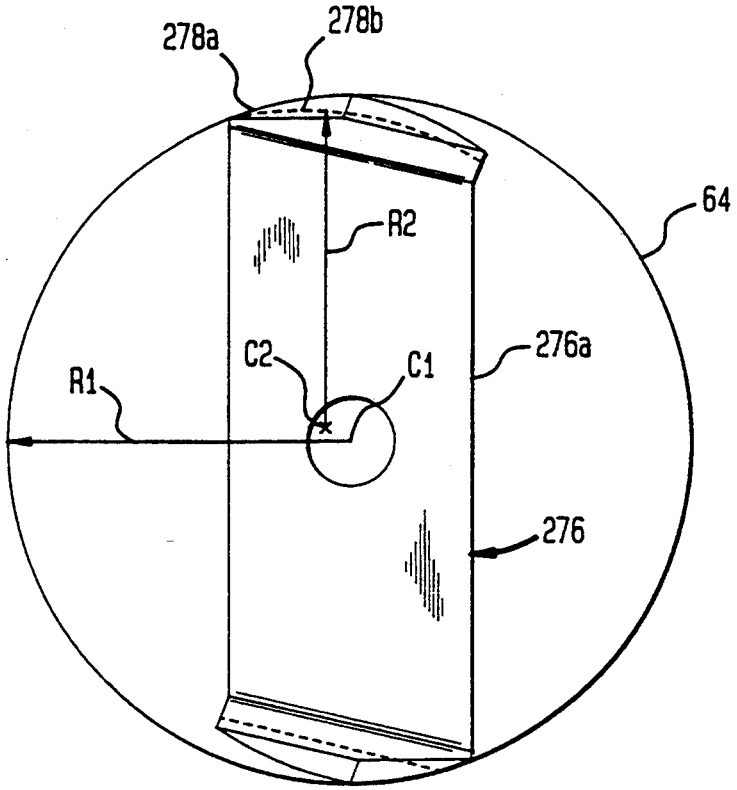
FIG. 24 is a plan view of a further exemplary embodiment of the rotating blade shown in FIG. 7.
Figure 25A:
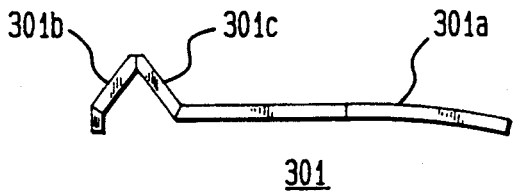
FIGS. 25*a*–25*d* show a further exemplary detachable mounting for the rotating blade shown in FIG. 7.
Figure 25B:
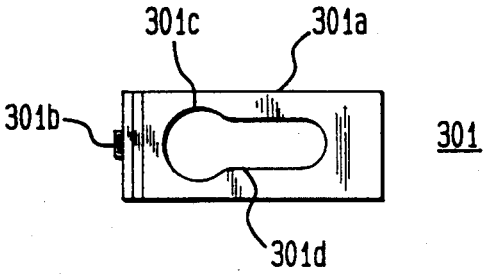
Figure 25D:
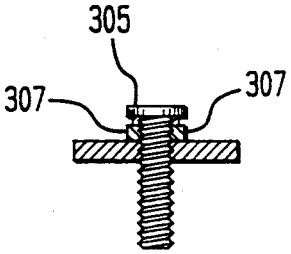
Figure 25C:
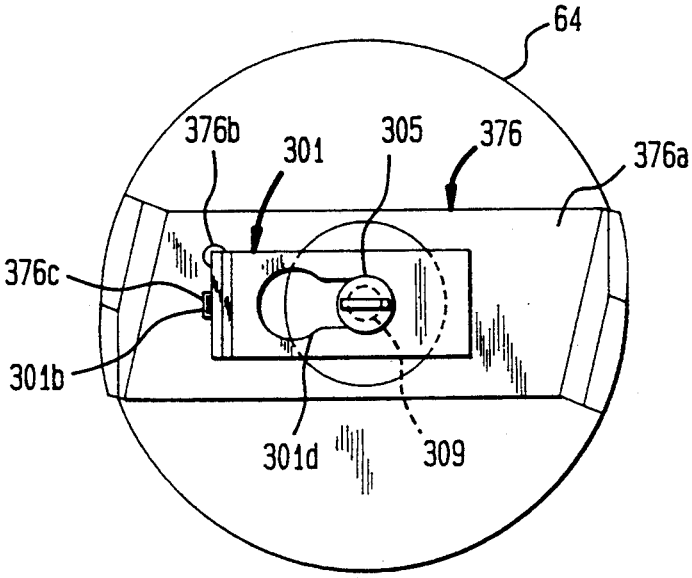

FIG. 24 shows an alternative configuration for the rotating blade. Rotating blade 276 is the same as blade 76 (shown in FIG. 7), except that surface 278*b* is not flat (as is surface 78*b* in FIG. 7); surface 278*b* is ground to a smaller radius R2 than the radius R1 of surfaces 278*a* and 78*a* (shown in FIG. 7). Surface 278*a* is ground to the same radius R1 as is surface 78*a* (FIG. 7), and has a center of curvature C1 on the longitudinal axis of the impeller 64. Surface 278*b*, on the other hand, has a different center of curvature C2.

The impeller cutting ear 278 with curved back surface 278*b* was developed to enhance the low pressure area in the fluid trailing the cutting ear 278. The inventors believe that this volume of low pressure is instrumental in preventing sinewy material from clogging holes 132 in the sieve ring 70. Without the curved back surface 278*b*, some particularly tough materials (e.g., polystyrene) caused clogging problems during testing.

With curved back surface 278*b*, the flow of fluid passing the rotating cutting ear 278 is believed to be less turbulent (as compared to a planar back surface 78*b* in FIG. 7) in the area between the cutting ear 278 and the sieve ring 70. With less turbulent flow in this area the change in pressure across the two sides of the ear 278 is greater. This is analogous to the flow of air over an airplane wing in stable flight versus the flow of air in a stalled configuration. When this curved back surface 278*b* was tested, sinewy material did not clogged sieve ring 70.

Also contemplated are quick release clips or clamps to hold the impeller blade 78 to the impeller disk 64. These clips or clamps will allow removal and replacement of the impeller blade 78 without the need of special tools or skilled technicians.

Referring now to FIGS. 25*a*–25*d*, a spring clip 301 (FIGS. 25*a*–25*c*) is made from spring steel and contains a key hole shaped opening 301*c*, 301*d* in its center. Clip 301 is slipped over a slotted impeller hub 309 (FIGS. 25*c* and 25*d*) via the larger portion 301*c* of the key hole opening. Spring clip 301 is then slid radially to engage the smaller hole 301*d* in the key hole opening with the annular slot 307 (FIG. 25*d*) in the impeller hub 309. A tab 301*b* (FIGS. 25*a*–25*c*) at the end of the bowed shape of the portion 301*a* (FIG. 25*a*) of spring clip 301 engages a detent 376*c* (FIG. 25*c*) in the face of the impeller base portion 376*a* and retain the clip 301 in position. A flanged bolt 305 (FIGS. 25*c*–25*d*) holds clip 301 in place. A hole 376*b* in member 376*a* allows insertion of a knife or screw driver to pry spring 301 loose when removing the blade 376.

Figure 26B:
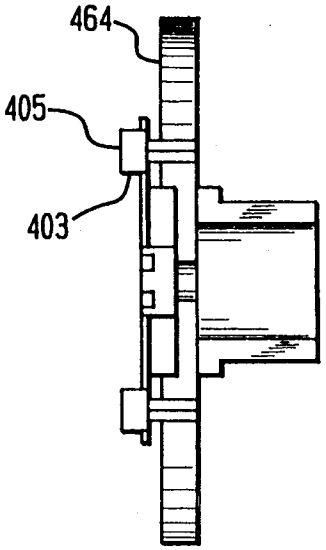
FIGS. 26*a* and 26*b* show a further exemplary detachable mounting for the rotating blade shown in FIG. 7.
Figure 26A:
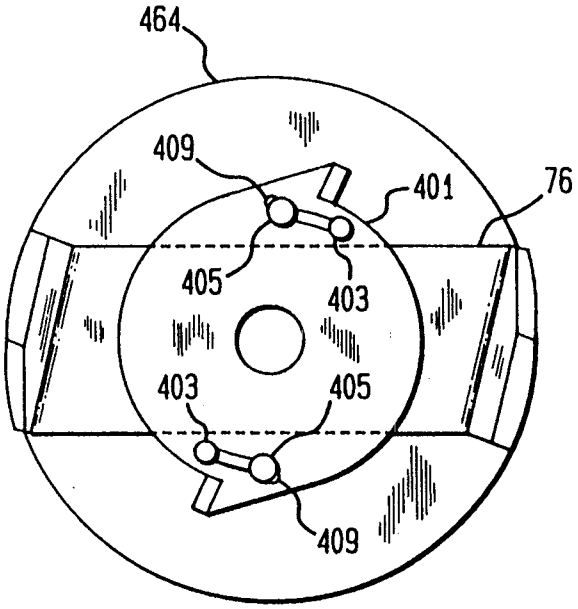

Alternately, a cam action bayonet type clamp 401 as shown in FIGS. 26*a* and 26*b* may be used. A cam action clamp 401 is shown with two key hole openings 403 which can engage shoulder studs 405 in the face of the impeller 464. In use clamp 401 is placed over impeller blade 76 (as shown in FIG. 7), which is retained against rotation in the slot in the face of the impeller 464, and the key hole slots 403 are engaged in the studs 405 protruding from impeller disc 464. Clamp 401 is then rotated to engage the cam action clamp into its detents 409 against the studs. The impeller blade 76 is captured underneath clamp 401.

Figure 6:
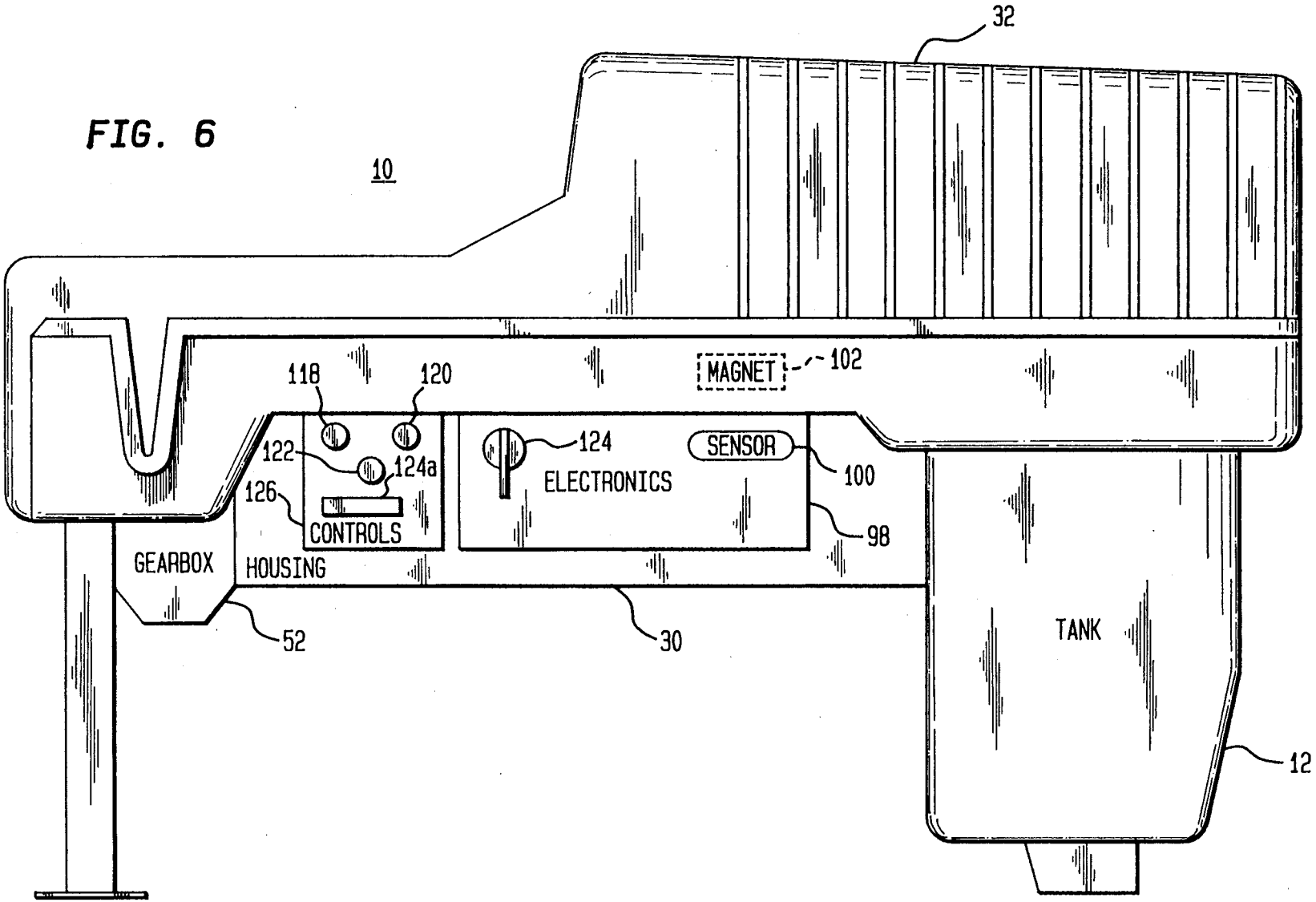
FIG. 6 is an elevation view of the system shown in FIG. 1.

Referring now to FIG. 6, a side elevation view of system 10 is shown. An enclosure 98 is provided for housing the electronics that control the operation of the apparatus. In order to enhance the safety of the system, a ferromagnetic element 102 is included in tray 32. An associated sensor 100 is mounted on the apparatus. In the exemplary embodiment sensor 100 is a Hall effect device that is capable of sensing changes in a magnetic field and is mounted with enclosure 98. Other mounting locations are contemplated as well. Sensor 100 detects when the magnetic field is changed due to the removal of tray 32 (and magnet 102). If tray 32 is removed, sensor 100 produces and transmits a signal to electronics in enclosure 98, which then disable motors 26 and 28. This prevents inadvertent operation of the cutting blades or the extraction assembly 31 while the tray 32 is not in place.

It is understood by one skilled in the art that a variety of detectors may be used in place of the Hall effect device 100. For example, a reed switch could perform a similar function.

Also included in enclosure 98 are controls for maintaining the appropriate water level within tank 12. During operation of system 10, a portion of the water supplied to the system is discharged along with the partially dried solids. This requires intermittent addition of water into tank 12 to maintain the appropriate fluid level. In the exemplary embodiment pneumatically controlled switches are contained in enclosure 98. Other pressure sensors (e.g. strain gauges, piezoelectric elements or capacitive pressure sensors) are contemplated. These pneumatic switches are coupled by a small hose (not shown) to the bottom of tank 12, to sense the pressure (head) at the bottom of the tank 12 or other type of level sensing. These switches or sensors control an electric water valve to add water as required to system 10. Alternatively, a separate pump may be used to supply the chemical.

It is understood by one skilled in the art that a conventional eductor may be used to draw waste treatment chemicals into the water that is supplied to tank 12, so that the waste is chemically treated during the pulping process.

System 10 also includes a simplified set of controls 126. A fill switch 118 actuates a valve to admit fresh water into tank 12. Respective controls 120 and 122 are provided for starting and stopping system 10 respectively. A power switch 124 is provided for turning power on and off to the system.

In the exemplary embodiments described above, an advanced cutting mechanism has been combined with a high efficiency liquid extraction assembly in a compact integrated system suitable for use in an environment having limited floor space. It is understood by those skilled in the art that the principles described herein may be applied in a variety of waste treatment and extraction systems. For example, the impeller assembly shown in FIG. 7 could replace the impeller in an otherwise conventional pulper. The extraction assembly 31 shown in FIGS. 2–4 could replace the corresponding equipment in an otherwise conventional liquid extraction system.

It is understood by one skilled in the art that many variations of the embodiments described herein are contemplated. While the invention has been described in terms of exemplary embodiments, it is contemplated that it may be practiced as outlined above with modifications within the spirit and scope of the appended claims.

What is claimed:

1. Waste pulping apparatus comprising:

a rotary disc impeller;

a sieve ring encircling the impeller and having a central axis;

first shearing means secured to the sieve ring and having a straight cutting edge that is parallel to the axis;

second shearing means detachably secured to the impeller and having a plurality of shearing members, each shearing member having a beveled cutting edge for periodically coming into play with the straight cutting edge, the shearing member inclining towards the sieve ring and the beveled cutting edge inclining in the direction of rotation of the impeller so that unpulpable material is pushed above the second shearing means and away from the impeller, the beveled cutting edge having a helical shape to maintain a substantially uniform radial distance between the beveled cutting edge and the straight cutting edge as the beveled cutting edge and the straight cutting edge come into play.

2. Apparatus according to claim 1, wherein the shearing members are inclined at an angle of approximately six degrees from the axis.

3. Apparatus according to claim 2, wherein the beveled cutting edge is beveled at an angle of approximately 32 degrees from a direction parallel to the axis.

4. Apparatus according to claim 1, wherein the second shearing means is detachably secured to a channel on the impeller.

5. Apparatus according to claim 1, further comprising a waste reservoir, wherein the waste pulping apparatus is mounted to an internal surface of the waste reservoir, and each shearing member includes an extension member above the beveled cutting edge for causing turbulence in the waste reservoir.

6. Apparatus according to claim 5, wherein the first shearing means includes an extension portion for periodically coming into play with the extension members of the shearing members of the second shearing means.

7. Apparatus according to claim 1, wherein the first shearing means comprises:

a blade holder fixed to the sieve ring, a detachable blade on which the straight cutting edge is located, and means for securing the detachable blade to the blade holder.

8. Apparatus according to claim 7, wherein:

the detachable blade comprises a longitudinally directed cutting member having a retaining tab attached at one end of the cutting member, transversely directed, and the blade holder includes a slot for receiving the tab to secure the detachable blade in place.

9. Apparatus according to claim 8, wherein the securing means include:

a slot at an end of the cutting member opposite the one end for engaging a portion of the sieve ring.

10. Apparatus according to claim 1, wherein the impeller includes a plurality of pumping ears mounted on a side of the impeller opposite the second shearing means, the pumping ears mounted in a direction that is approximately 45 degrees from a tangent to an outer diameter of the impeller.

11. In a waste handling system, liquid extraction apparatus for removing liquid from a mixture of liquid and solids, comprising:

an input port for providing the mixture of liquid and solids;

a stationary helical screw having an input end, a discharge end and a shaft diameter that increases from the input end to the discharge end;

a sieve having a cylindrical sieve surface surrounding the screw, the sieve rotatably mounted to the input port;

means for rotating the sieve about the screw to move the solids along the screw longitudinally towards the discharge end; and restriction means for controlling backpressure in the sieve so that the liquid drains out of the sieve, the restriction means including a flexible restrictor mounted at the discharge end.

12. Apparatus according to claim 11, wherein the screw and sieve are aligned substantially horizontally.

13. Apparatus according to claim 11, wherein the restrictor has an inner diameter that is approximately equal to the shaft diameter of the screw at the discharge end.

14. Waste pulping and liquid extraction apparatus, comprising:

a tank for containing liquid and solids having an input port for receiving liquid, a rotary disc impeller mounted therein for grinding the solids to form a mixture of liquid and solids;

a stationary helical screw horizontally mounted directly to the tank and having a receiving end adjacent to the tank and a discharge end, the tank including means for conducting the mixture to the receiving end;

a sieve having a cylindrical sieve surface surrounding the screw through which the liquid drains, the sieve rotatably mounted to the tank;

means for rotating the sieve about the screw to move the solids longitudinally towards the discharge end; and a housing surrounding the sieve and mounted directly to the tank for communicating liquid that drains from the sieve back to the tank by way of the input port.

15. Apparatus according to claim 14, wherein the rotating means is positioned at the discharge end.

16. Apparatus according to claim 14, wherein the rotating means is mounted on the housing.

17. Apparatus according to claim 16, wherein the housing is mounted to the input port of the tank by way of a cantilever mounting.

18. Apparatus according to claim 14, further comprising a feed tray mounted above the tank for receiving solid waste material and for providing the waste material at a top portion of the tank.

19. Apparatus according to claim 18, wherein the impeller is mounted on a bottom portion of a side wall of the tank and is remotely located from the feed tray, whereby human access to the impeller is prevented while the feed tray is mounted on the tank.

20. Apparatus according to claim 19, further comprising:

sensing means for sensing when the feed tray is removed from the tank; and control means coupled to the sensing means for cutting off power to the impeller and to the rotating means when the feed tray is removed from the tank.

21. Apparatus according to claim 20, wherein the sensing means include a hall effect device.

22. In a waste handling apparatus, a method for compacting and extracting liquid from a mixture of liquid and solids, comprising the steps of:

providing the mixture of liquid and solids at a receiving end of a sieve that has a cylindrical sieve surface;

rotating the sieve to expel liquid through the sieve surface;

compressing the mixture radially to expel additional liquid through the sieve surface;

advancing the solids longitudinally within the sieve, from the receiving end to a discharge end of the sieve; and compressing the solids longitudinally between a screw and a flexible restrictor to expel additional liquid from the sieve surface.

23. A method according to claim 22, wherein the step of rotating the sieve includes rotating the sieve at a speed between 200 and 250 revolutions per minute.

24. A method according to claim 22, wherein the step of advancing the solids longitudinally includes moving the solids horizontally from the receiving end to the discharge end.

25. Apparatus according to claim 14, wherein the tank provides mechanical support to the screw, the sieve and the housing.

26. Apparatus according to claim 14, wherein the tank includes conduit means for conducting fluid between the impeller and the sieve.

27. In a waste treatment system, liquid extraction apparatus for removing liquid from a mixture of liquid and solids, comprising:

an input port for providing the mixture of liquid and solids;

a stationary helical screw having an input end, a discharge end and a shaft diameter that increases from the input end to the discharge end;

a sieve having a cylindrical sieve surface surrounding the screw, the sieve rotatably mounted to the input port; and means for rotating the sieve about the screw to move the solids longitudinally along the screw towards the discharge end, the rotating means including a rotatable cylindrical collar surrounding the sieve, the collar including detachable mounting means for receiving the sieve and for transmitting torque to the sieve to rotate the sieve, wherein the sieve and the screw are slidably mounted to the input port and slidably removable from the apparatus by pulling the sieve and the screw through the collar.

28. Apparatus according to claim 11, wherein the flexible restrictor is in the form of an annular ring.

29. Apparatus according to claim 14, further comprising a flexible restrictor positioned at the discharge end, such that solids are compressed between the screw and the restrictor.

30. Apparatus according to claim 29, wherein the restrictor is an annular ring having an inner diameter that is approximately equal to the shaft diameter of the screw at the discharge end.

31. Apparatus according to claim 14, wherein the impeller has an assembly comprising:

a sieve ring encircling the impeller and having a central axis;

first shearing means secured to the sieve ring and having a cutting edge; and second shearing means detachably secured to the impeller and having a plurality of shearing members, each shearing member having a cutting edge for periodically coming into play with the cutting edge of the first shearing means.

32. Apparatus according to claim 31, wherein:

the cutting edge of the first shearing means is straight and parallel to the axis;

the cutting edge of each shearing member of the second shearing means is beveled, and each shearing member is inclined towards the sieve ring, so that the respective beveled cutting edge of each shearing member inclines in the direction of rotation of the impeller, the beveled cutting edge having a helical shape to maintain a substantially uniform radial distance between the beveled cutting edge and the straight cutting edge as the beveled cutting edge and the straight cutting edge come into play.

33. Apparatus according to claim 31, wherein the waste pulping apparatus is mounted to an internal surface of the tank, and each shearing member includes an extension member above the beveled cutting edge for causing turbulence in the tank.

34. Apparatus according to claim 33, wherein the first shearing means includes an extension portion for periodically coming into play with the extension members of the shearing members of the second shearing means.

35. Apparatus according to claim 31, wherein the first shearing means comprises:

a blade holder fixed to the sieve ring, a detachable blade on which the cutting edge of the first shearing means is located, and means for securing the detachable blade to the blade holder.

36. Apparatus according to claim 14, wherein the impeller includes a plurality of pumping ears mounted on a side of the impeller opposite from a center of the tank, the pumping ears mounted in a direction that is approximately 45 degrees from a tangent to an outer diameter of the impeller.

* * * * *

UNITED STATES PATENT AND TRADEMARK OFFICE

CERTIFICATE OF CORRECTION

PATENT NO. : 5,451,004
DATED : September 19, 1995
INVENTOR(S) : Altonji et al.

It is certified that error appears in the above-identified patent and that said Letters Patent is hereby corrected as shown below:

Page 2 of the Cover Sheet, item [56] U.S. PATENT DOCUMENTS, Åhs reference, delete "2/1990" and insert --7/1990-- .

Signed and Sealed this

Sixteenth Day of January, 1996

*Attest:*

*Attesting Officer*

BRUCE LEHMAN

*Commissioner of Patents and Trademarks*